US012697532B1

(12) United States Patent
Patel et al.

(10) Patent No.: US 12,697,532 B1
(45) **Date of Patent: *Aug. 4, 2026**

(54) MODULAR AND TUNABLE PUTTER HEAD

(71) Applicant: Indesign Products Inc., Boise, ID (US)

(72) Inventors: Shamik Patel, Boise, ID (US); Sunil Patel, Boise, ID (US); Philip Kennedy, Meridian, ID (US); Elijah J. Batemon, Boise, ID (US); James Hewett, Garden City, ID (US)

(73) Assignee: Indesign Products, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/454,224

(22) Filed: Jan. 20, 2026

Related U.S. Application Data

(63) Continuation-in-part of application No. 19/322,626, filed on Sep. 8, 2025, now Pat. No. 12,582,881.

(60) Provisional application No. 63/846,109, filed on Jul. 17, 2025.

(51) Int. Cl.
*A63B 53/04* (2015.01)
*A63B 53/06* (2015.01)
*A63B 60/04* (2015.01)

(52) U.S. Cl.
CPC ..... *A63B 53/065* (2013.01); *A63B 60/04* (2015.10); *A63B 2053/0491* (2013.01)

(58) Field of Classification Search
CPC ..... A63B 53/0487; A63B 2053/0491; A63B 2053/0495; A63B 53/065
USPC ..... 473/334–340; D21/733–753
See application file for complete search history.

(56) References Cited

U.S. PATENT DOCUMENTS 4,519,612 A * 5/1985 Tsao ..... A63B 53/0487 473/250
4,714,252 A * 12/1987 Roraback ..... A63B 60/02 473/338
4,754,976 A * 7/1988 Pelz ..... A63B 53/0487 473/340
D309,766 S * 8/1990 Pelz ..... D21/735
4,999,000 A * 3/1991 Finney ..... A63B 53/0487 473/341
5,060,950 A * 10/1991 Finney ..... A63B 53/0487 473/341

(Continued)

FOREIGN PATENT DOCUMENTS

CN 201205434 Y * 3/2009
CN 101683558 A * 3/2010
JP H0440673 U * 4/1992

*Primary Examiner* — Alvin A Hunter
(74) *Attorney, Agent, or Firm* — Burdick Patents, P.A.; Sean D. Burdick; Colin L. Honan

(57) ABSTRACT

A modular and tunable putter head has a body defining an impact face between a top surface and a bottom surface, and a means formed in the top surface for engaging a shaft. A platform parallel to the bottom surface extends from the body and a boss extends from the platform. A weighted artifact attachable to the platform includes an engagement channel formed in its bottom surface to engage the boss. A screw extends through the platform to lock the artifact onto the platform. The engagement between the platform and the artifact allows a player to tune the putter head by rotating the artifact relative to the impact face thereby shifting its center of gravity and changing its moment of inertia to optimize a putting stroke.

21 Claims, 19 Drawing Sheets

(56) References Cited

U.S. PATENT DOCUMENTS 5,558,332 A * 9/1996 Cook ..... A63B 53/0487 473/341
5,683,307 A * 11/1997 Rife ..... A63B 53/0487 473/340
5,785,608 A * 7/1998 Collins ..... A63B 53/0487 473/294
5,797,176 A * 8/1998 Rose ..... A63B 53/0487 473/340
5,830,078 A * 11/1998 McMahan ..... A63B 60/02 473/341
D500,109 S 12/2004 Solheim et al.
6,960,140 B2 11/2005 Solheim et al.
7,052,411 B2 5/2006 Solheim et al.
7,074,132 B1 * 7/2006 Finn ..... A63B 53/0487 473/335
7,086,957 B2 8/2006 Solheim et al.
D532,842 S 11/2006 Jones et al.
D532,843 S 11/2006 Jones et al.
7,156,752 B1 * 1/2007 Bennett ..... A63B 60/02 473/340
7,186,185 B2 * 3/2007 Nagy ..... A63B 60/02 473/238
7,235,021 B2 6/2007 Solheim et al.
7,351,162 B2 * 4/2008 Soracco ..... A63B 60/02 473/340
7,396,289 B2 * 7/2008 Soracco ..... A63B 53/0487 473/340
7,455,599 B2 * 11/2008 Jones ..... A63B 53/0487 473/340
7,491,131 B2 * 2/2009 Vinton ..... A63B 60/02 473/340
D600,760 S 9/2009 Serrano et al.
7,625,298 B2 * 12/2009 Bennett ..... A63B 53/02 473/341
7,918,745 B2 * 4/2011 Morris ..... A63B 53/04 473/340
8,096,039 B2 * 1/2012 Soracco ..... A63B 53/0487 473/340
8,308,583 B2 * 11/2012 Morris ..... A63B 60/02 473/340
8,956,245 B2 * 2/2015 Brandt ..... A63B 53/04 473/340
9,044,662 B2 * 6/2015 Demkowski ..... A63B 60/02
D741,967 S * 10/2015 Davis ..... D21/736
9,604,108 B1 * 3/2017 Dunnell ..... A63B 60/02
9,844,707 B2 * 12/2017 Davis ..... A63B 53/02
D816,175 S 4/2018 Solheim et al.
10,456,637 B2 * 10/2019 Becktor ..... A63B 53/0487
D1,114,913 S 2/2026 Serrano et al.
12,582,881 B1 * 3/2026 Patel ..... A63B 53/08
2002/0025859 A1 * 2/2002 Finn ..... A63B 60/42 473/340
2004/0063516 A1 * 4/2004 Cameron ..... A63B 53/0487 473/340
2004/0266543 A1 * 12/2004 Goldsmith ..... A63B 53/0487 473/251
2005/0164805 A1 * 7/2005 Durnin ..... A63B 60/02 473/340
2005/0221908 A1 * 10/2005 Gornall ..... A63B 53/007 473/285
2005/0255930 A1 * 11/2005 Johnson ..... A63B 69/3617 473/340
2006/0040763 A1 * 2/2006 Soracco ..... A63B 60/02 473/409
2006/0040764 A1 * 2/2006 Soracco ..... A63B 53/0487 473/340
2006/0058112 A1 * 3/2006 Haralason ..... A63B 60/02 473/345
2006/0068935 A1 * 3/2006 Tang ..... A63B 60/02 473/340
2006/0100030 A1 * 5/2006 Hasegawa ..... A63B 60/02 473/340
2006/0189408 A1 * 8/2006 Grace ..... A63B 60/02 473/340
2006/0223650 A1 * 10/2006 Lai ..... A63B 60/00 473/340
2007/0155537 A1 * 7/2007 Morris ..... A63B 60/02 473/340
2007/0191130 A1 * 8/2007 Kouldus ..... A63B 60/02 473/251
2007/0243943 A1 * 10/2007 Inouye ..... A63B 60/02 473/340
2008/0009361 A1 * 1/2008 Johnson ..... A63B 53/0487 473/340
2008/0176672 A1 * 7/2008 Roach ..... A63B 60/02 473/340
2009/0098947 A1 * 4/2009 Bennett ..... A63B 53/04 473/340
2009/0105009 A1 4/2009 Cole
2011/0190070 A1 * 8/2011 Morris ..... A63B 53/0487 473/251
2012/0122607 A1 * 5/2012 Reinberg ..... A63B 60/02 473/334
2015/0151169 A1 * 6/2015 Davis ..... A63B 53/02 473/313
2016/0023059 A1 * 1/2016 Miller ..... A63B 60/02 473/337
2016/0114230 A1 * 4/2016 Jones ..... A63B 53/0487 473/333
2017/0014689 A1 * 1/2017 Davis ..... A63B 53/007

* cited by examiner

SECTION A-A

SECTION C-C

SECTION D-D

SECTION F-F

MODULAR AND TUNABLE PUTTER HEAD

RELATED APPLICATIONS

This application claims priority to and is a continuation-in-part of U.S. patent application Ser. No. 19/322,626 filed Sep. 8, 2025, which claims priority to U.S. Provisional Application 63/846,109, filed Jul. 17, 2025, the contents of all of which are hereby incorporated herein by reference.

BACKGROUND OF THE INVENTION

Field of the Invention

The present invention relates generally to golf clubs, and more specifically, to weighted putter heads.

Description of Related Art

The game of golf, or simply "golf", has a long and storied history, with its origins generally accepted as dating back to 15th century Scotland. Golf spread from Scotland throughout the rest of Europe during the 16th century and was officially recognized as a sport in the 18th century when the first club was formed, known as the Gentlemen Golfers of Leith, and an annual competition was established. From the 17th century onward, golf was exported from Europe with the rise of the British Empire and gained popularity across British colonies worldwide. By the mid-1700s, golf had arrive in what would become the United States. Since these early days, golf has exploded in popularity in the United States, with more than 16,000 golf course open and operating today. Almost half of the golf course worldwide are located in the United States today.

Along with the growth in popularity for golf, the equipment used to play the game has also changed significantly over the centuries. In the early days, golf was played with a set of handcrafted wooden clubs having a wooden shaft and a wooden head. Similar to today, there were several different styles of clubs depending on the distance a player needed to hit the ball. Eventually, the wooden club head was replaced with a cast iron head for most clubs. However, it was not until the late 1800s that putter heads began being made from iron and other metals.

The putter is the club a player uses for the final series of shots after reaching the green. The putter and putting stroke is unique to golf and this club is typically only used when on the green. A putting stroke does not involve a full swing, like a driver or iron shot would, but instead requires precision and control to allow the player to roll the ball along a precise line to reach the hole. An ideal putting stroke may only involve a maximum backswing of 12 to 16 inches. Typically, the putter head is swung forward in a pendulum-type motion so that the head meets the ball at the center of the stroke to propel it forward. At the end of the putting swing, the putter head may achieve a maximum rise of only a few inches above ground.

A putter is typically designed to have a vertically flat impact face so that when the ball is struck it will roll along the green instead of being lofted into the air. The body of the putter head is typically solid and is weightier than the other clubs a player might use. Throughout the 1900s, various putter head designs were introduced that replaced earlier designs. Today, putter heads can come in one of several designs, such as a blade putter or a mallet putter. The blade putter most closely resembles putter designs that were popular in the 1900s that have a vertically flat impact face and a body formed behind the impact face. The body of a blade putter head is typically machined or cast from metal to add weight to the head and establish a desired center of gravity. The body may only extend half an inch to an inch behind the impact face. In contrast, a mallet putter is typically heavier than a blade putter, and the head of the mallet putter has a body that extends more than an inch behind the impact face. Some mallet putter heads may have a rectangular or rounded body extending rearward from the impact face. Again, these are typically machined or cast from metal and formed to locate the center of gravity at an optimal point on the putter.

Some putter heads today offer the player the ability to customize the weight of the head by adding or removing small weights attached to the head. The customization, however, is limited to minor weight alterations that do not affect the overall appearance of the putter head. These putters allow a player to change the center of gravity of the putter head to match their specific stroke. For instance, U.S. Pat. No. 7,156,752 (the "'752 Patent") discloses variously styled putter heads that have one or more threaded apertures to receive a threaded weight. In some embodiments of the '752 Patent, the weights are completely enclosed within a housing extending rearwardly from the impact face, e.g., for a mallet style putter, while in other embodiments the weights are directly attached to the rear of the impact face, e.g., for a blade style putter. These weights are fixed to the putter head and cannot move during the putting stroke to ensure compliance with the rules of golf, which require that the characteristics of the a club cannot be changed during play, i.e., the center of gravity must remain fixed during play.

A problem with existing putter designs is the lack of customizability in a modern world where each consumer prefers to equip himself with articles that are unique to the player. While putter head designs in general may be unique from each other, i.e., blade versus mallet, the player has limited options to customize the head apart from picking the style of putter and the limited ability to alter the weight of the putter head.

What is needed is putter head that allows a player to alter the weight of the putter head and customize the aesthetic appearance of such head without sacrificing performance.

SUMMARY OF THE INVENTION

The following disclosure presents exemplary embodiments for various putter heads that are aesthetically and functionally customizable. The disclosed invention can provide a putter head in a hybrid-blade style, a mallet style, and a hybrid-mallet style to allow the player to change the weight of the putter head, alter the center of gravity, and attach various artifacts in the form of sculptures, figurines, or three-dimensional models that change the aesthetic appearance of the club. The performance of the club may be altered by the player through the selection of the artifact, the relative positioning of the artifact in regard to the impact face, and the selected weight attached thereto.

In a first embodiment of the present invention, a putter head is disclosed. The putter head has a body that defines a top surface, a bottom surface, and an impact face that is formed between the top surface and the bottom surface. A platform extends from the body in a direction opposite the impact face, i.e., rearward. A means for engaging a putter shaft extends from the top surface of the body. The putter shaft engagement means may include a hosel or may include a putter shaft being directly attached into the body of the putter head. A weighted artifact extends from the platform above a top plane of the impact face. This places the removable weight substantially above the top plane of the impact face. A means for removably attaching the weighted artifact to the platform is also included.

In some embodiments, the platform is formed as substantially circular base that extends rearwardly from the body. The circular base is substantially coplanar with the bottom surface of the body. The removable attachment means may include a plurality of magnets embedded in the circular base. The magnets may be symmetrically arranged around a perimeter of the circular base, e.g., every 60-degrees. The weighted artifact preferably includes a plurality of magnets that are arranged complementary to the magnets embedded in the circular base. In such embodiments, the removable attachment means includes the magnetic connection between the weighted artifact and the circular base.

In other embodiments where the platform is formed as a circular base, a lip extends around the perimeter of the base to define a depth. Preferably, the weighted artifact is designed to fit within the depth of the circular base formed by the lip. The removable attachment means may include a friction-fit of the weighted artifact within the depth of the circular base. Alternatively, the removable attachment means may be a threaded connection between the weighted artifact and the circular base, the threads being formed around the internal perimeter of the circular base and complementary threads formed around a lower end of the weighted artifact.

In some embodiments, the weighted artifact includes a base and an artifact extending vertically from the base. The base is configured for attachment to the platform via the removable attachment means. In some embodiments, the artifact itself is weighted, e.g., a sculpture or figurine formed from metal. Alternatively, the artifact may enclose one or more weights, such as small metal discs. The artifact is positioned above the top plane of the impact face, placing the weight above the top plane of the impact face.

In some embodiments, the platform is formed as a mallet extending rearwardly from the body. Similarly, in some embodiments, the platform may include alternatively shaped bases, such as triangular, rectangular, hexagonal, among other geometric shapes. The platform base, in whatever geometric shape, is designed to engage the weighted artifact, which preferably includes a complementary-shaped base end for engagement with the platform base.

In further embodiments, the body defines a toe end and a heel end. The platform extending from the back side of the body may include a wing arching off a rear end of the platform between the toe end and the heel end of the body. The arched wing includes a toe tip proximate the toe end of the body and a heel tip proximate the heel end of the body. Preferably, each of the toe tip and the heel tip angle upward toward the top plane of the impact face. The toe tip and the heel tip, however, do not touch the body of the club head, leaving a space between the terminal ends of the arched wing and the body. The arched wing otherwise is substantially coplanar with the bottom surface of the body.

In preferred embodiments, the weighted artifact is rotatable around the platform. Preferably, rotation of the weighted artifact is about an axis of rotation and causes a change to the center of gravity of the putter head relative to the impact face simultaneously along two orthogonal axes that are parallel to the bottom surface of the putter head body and that are normal to the axis of rotation.

In some embodiments, the weighted artifact is a sculpture or a figurine. In alternative embodiments, the weighted artifact is a three-dimensional model of a famous golf course hole, such as the 16th hole at TPC Scottsdale or the 12th hole at Augusta National. Any golf course hole may be made into a two-dimensional or a three-dimensional model formed as the weighted artifact according to the present invention. Similarly, any sculpture or figurine may be formed into the artifact, e.g., a superhero figurine or sculpture. The weighted artifact may be cast or machined from various types of metal or, alternatively, injection molded from one or more polymers, such as polyoxymethylene. In alternative embodiments, the weighted artifact may be formed from one or more of a variety of materials, includes plastics, metal, rubber, carbons, graphite, etc. The exact material selected for the weighted artifact may influence the relative size of the artifact given the need to maintain balance of the putter head with the other components present, namely, the body.

Preferably, the weighted artifact has a base that is configured to engage the platform via the removable attachment means and an asymmetric artifact that extends vertically from the base. The weighted artifact is preferably rotatably engaged to the platform so that the weighted artifact can be rotated relative to the platform. In some embodiments, the asymmetric artifact extends forward beyond the impact face and above the top plane thereof. In alternative embodiments, the asymmetric artifact is arranged to be parallel to the impact face while above the top plane thereof. The rotatability of the weighted artifact allows a player to arrange the asymmetric artifact in any desired position relative to the impact face. In some embodiments, the forward plane of the asymmetric artifact is positioned behind the impact face and above the top plane thereof. The asymmetric artifact may include an uneven weight distribution. The uneven weight distribution may include a heavier left, right, front, or back side when compared to any of the other sides of the asymmetric artifact. As such, the putter head is engineered so that the center of gravity changes based on the orientation of the asymmetric artifact relative to the impact face.

In some further embodiments, the platform includes a circular base extending rearward from the body and having a lip formed around a perimeter and defining a depth. The weighted artifact includes an artifact extending vertically from a base that is complementary to the circular base. The removable attachment means may include a threaded connection between the circular base and the base of the weighted artifact or a friction fit of the artifact base within the depth of the circular base.

In some preferred embodiments, the body of the putter head is formed from machined metal. The metal may be titanium, stainless steel of any grade, and/or zirconium. In other preferred embodiments, the weighted artifact may include an asymmetrical weight distribution above the top plane of the impact face.

In some further alternative embodiments, the weighted artifact may be composed of two pieces that are removably coupled together and removably coupled to the platform via the removable attachment means. Such embodiments may include a weighted artifact base that has a bottom surface and a top surface. The bottom surface is designed to removably couple to the platform via the removable attachment means. The top surface is designed to removably couple to a weighted artifact to position the artifact above the top plane of the impact face. The top surface thus may include a plurality of magnets embedded therein while the artifact includes one or more complementary magnets embedded in the bottom surface of the artifact. In some preferred embodiments, the base may be formed substantially in the shape of a golf ball, having a flat bottom surface to engage the platform and a flat top surface to engage the weighted artifact. However, it should be recognized that various other geometric shapes or designs may be used for the artifact base so long as the bottom surface is made complementary to the platform to be coupled therewith via the removable attachment means, and so that the top surface of the base is configured to engage a desired artifact.

The weighted artifact may be a sculpture or a two-dimensional or three-dimensional model, such as a three-dimensional model of a famous golf hole like the 16th hole at TPC Scottsdale. In such embodiments, the player is provided with additional customizability for their putter head in that different artifact bases may be coupled to different types of weighted artifacts, e.g., a sculpture, a figurine, and/or a 2D or 3D model, without having to change the putter head.

In further embodiments of the invention, there is disclosed a putter head having a body that defines a top surface, a bottom surface, and an impact face formed between the top surface and the bottom surface. A platform extends in a direction perpendicular to the impact face. A means formed in the top surface for engaging a putter shaft is included. A weighted artifact extends from the platform above the top surface and there is a means for removably attaching the weighted artifact to the platform. In some embodiments, the platform is substantially circular.

In some further embodiments, the platform includes at least one first aperture defined therethrough and the weighted artifact includes at least one second aperture defined therein. The removable attachment means may include at least one screw that is extendable through the at least one first aperture and engageable with the at least one second aperture.

In further preferred embodiments, the removable attachment means may include a plurality of magnets embedded in the platform and a plurality of complementary magnets embedded in a bottom surface of the weighted artifact to magnetically attach the weighted artifact to the platform. The removable attachment means may also include a screw threadably engageable through complementary apertures defined through the platform and in the weighted artifact. In further embodiments, the removable attachment means also includes a means for rotatably attaching the weighted artifact to the platform.

Preferably, the platform includes a lip extending around a perimeter of the platform and defining a depth. The removable attachment means may be designed as a friction-fitment of the weighted artifact to the platform within the depth formed by the lip. In some further embodiments, the platform may include a plurality of dimples defined within the perimeter of the lip and the weighted artifact includes a plurality of bosses that are arranged complementary to the dimples. The bosses extend downward from a bottom surface of the weighted artifact.

In some further alternative embodiments, the removable attachment means is designed as a bayonet connection. As such, the lip of the platform includes two or more slots formed therein. Each slot forms a ledge in the lip. The weighted artifact includes two or more arms extending downward from a perimeter of the bottom surface. The arms are preferably arranged to be complementary to the slots.

In other embodiments, the weighted artifact includes a base and an ornament. The base may include a means for removably and rotatably attaching the ornament to the base. In some preferred embodiments, the removable attachment means and the removably and rotatably attaching means have an identical configuration. The ornament of a weighted artifact may be a symmetrical or asymmetrical sculpture or model.

In further embodiments, the invention relates to a putter head having a body that defines a top surface, a bottom surface, and an impact face. A platform extends perpendicular to the impact face. Formed in the top surface is a means for engaging a putter shaft. A weighted artifact extends from the platform above the top surface. The weight artifact includes a base having a top surface and a bottom surface, and an ornament removably and rotatably coupled to the top surface. The putter head includes a means for removably attaching the base to the platform. Preferably, the bottom surface of the base has a configuration that is complementary to the platform. The removable attachment means may include a plurality of complementary magnets embedded in the platform and in the bottom surface of the base. Preferably, the plurality of complementary magnets are radially symmetrically arranged to allow the base to be rotated around the platform relative to the impact face.

In further embodiments of the present invention, there is a putter head having a body defining a top surface, a bottom surface and an impact face formed between the top surface and the bottom surface. The body also includes a platform extending in a direction parallel to the bottom surface. A means for engaging a putter shaft is formed in the top surface of the body. A boss extends from the platform and a weighted artifact is attachable to the platform. The weighted artifact has a top side and a bottom side. The bottom side of the weighted artifact has an engagement channel formed therein and configured to engage the boss extending from the platform. The putter head also includes a means for removably locking the weighted artifact to the platform.

In preferred embodiments, the putter head also includes a means for rotating the weighted artifact with respect to the platform to shift a center of gravity of the putter head along two orthogonal axes that are parallel to the bottom surface of the putter head body and that are normal to the axis of rotation. In some embodiments, the rotation means includes one or more locking dimples formed in the engagement channel of the weighted artifact. The locking dimples are designed to engage the boss extending from the platform to position the weighted artifact at a set angle relative to the impact face.

In some embodiments, the weighted artifact extends from the platform in a direction opposite the impact face and parallel to the bottom surface of the body. The weighted artifact may include a circular body engageable to the platform, an arm extending from the circular body, and a T-shaped extension extending from the arm.

In preferred embodiments, the engagement channel defines an adjustment arc that allows the weighted artifact to be rotated relative to the impact face. The adjustment arc may be between 120-degree and 180-degree arc. In some embodiments, adjustment of the weighted artifact along the adjustment arc is designed to shift the face balance of the putter head between a heel end of the body and a toe end of the body. In some embodiments, adjustment of the weighted artifact along the adjustment arc is designed to change the moment of inertia of the putter head causing a shift to the sweet spot of the impact face between the heel end and the toe end of the body.

In preferred embodiments, the engagement channel includes a plurality of locking dimples forming the adjustment arc. Each locking dimple is designed to engage the boss to secure the weighted artifact at a set angle relative to the impact face. Preferably, the locking dimples are equally spaced apart forming the adjustment arc. In some embodiments, each locking dimple is designed to cause a change to the set angle in 15-degree increments.

In some embodiments, the putter head may also include a puck weight removably engaged to the weighted artifact. The puck weight may be attached to the top surface of the weighted artifact or be attached between the platform and the weighted artifact.

In some more elaborate embodiments of the present invention, the putter head may include a body defining a top surface, a bottom surface and an impact face formed between the top surface and the bottom surface. The body includes a platform extending in a direction parallel to the bottom surface. A means for engaging a putter shaft is formed in the top surface. A weight artifact extends from the platform. The putter head also includes a means for removably attaching the weighted artifact to the platform and a means for rotating the weighted artifact about an axis of rotation to cause a change to a center of gravity of the putter head relative to the impact face simultaneously along two orthogonal axes that are parallel to the bottom surface and normal to the axis of rotation.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments of a functionally and aesthetically customizable putter head. The putter head according to the present invention allows a player to customize the aesthetic appearance of the putter head by offering a selection of various weighted artifacts that can be removably coupled to the putter head and also provides for customization of the functionality of the putter head by allowing the player to readily modify the weight of the putter head based on the selection of the weighted artifact that is engaged thereto. The functionality of the putter head is also modified based on the relative positioning of the weighted artifact in regard to the impact face, which alters the weight distribution of the putter head.

In preferred embodiments, the putter head according to the present invention is machined titanium or titanium alloys. In other embodiments, the putter head may be machined from various grades of stainless steel, tungsten, copper and other metals and alloys thereof. The weighted artifact removably coupled to the putter head, as described further below, may also be machined from various types of metal or alternatively, injection molded or by additive manufacturing processes, e.g., 3-D printing. In some embodiments, the weighted artifact is formed from aluminum, titanium, various grades of stainless steel, copper, tungsten, or various alloys of any of the aforementioned materials. In some embodiments, the weighted artifact may be molded or printed from one or more polymer materials, rubber materials, or metals. The material selected for the weighted artifact will determine the weight of that piece of the putter head and its impact on the customization of the putter head. In some embodiments, the weighted artifact is weighted based on the materials used to manufacture it. Alternatively, the weighted artifact may be formed to enclose one or more individual weights, which may provide a symmetric or asymmetric weight distribution for the weighted artifact.

Figure 1:
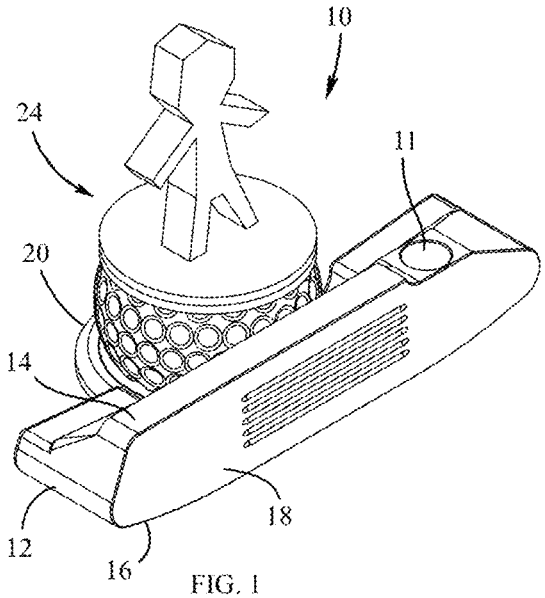
FIG. 1 is a perspective front view of an embodiment of a putter head according to the present invention.

FIG. 1 is a front perspective view of a first embodiment of a putter head according to the present invention. The putter head 10 includes a body 12 defining a top surface 14 and a bottom surface 16. An impact face 18 is defined between the top surface 14 and the bottom surface 16. The impact face 18 is substantially flat and vertically oriented to extend between the top surface 14 and the bottom surface 16. The impact face 18 is the portion of the putter head 10 designed to strike the golf ball during a normal putting stroke. In some embodiments, the impact face 18 may be textured or powder coated. The top surface 14 also includes a means for engaging a putter shaft. The putter shaft engagement means 11 may be a conventional hosel or an aperture designed to directly receive the putter shaft. The putter shaft engagement means 11 may be formed at any position along the top surface 14 of the body 12, e.g., left, center, or right ends of the body, as is known for existing putters.

Figure 2:
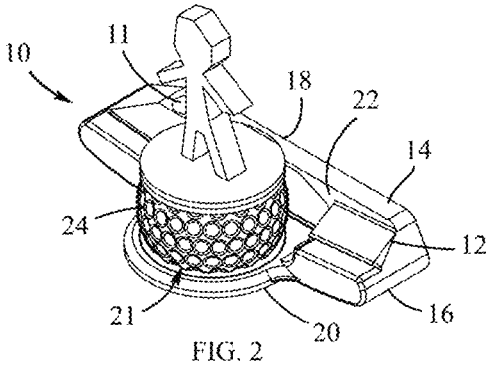
FIG. 2 is a perspective rear view of an embodiment of a putter head according to the present invention.

FIG. 2 is a rear perspective view of the first embodiment of a putter head according to the present invention. The hybrid-blade body 12 of the putter head 10 also includes a platform 20 extending perpendicular to the impact face 18. Said another way, the platform 20 extends from the rear side 22 of the body 12. A weighted artifact 24 is removably and rotatably coupled to the platform 20. As discussed in further detail below, the platform 20 has a means 21 for removably attaching the weighted artifact 24 to the platform. In most preferred embodiments, the removable attachment means 21 also provides for the rotatability of the weighted artifact 24 with regard to the impact face 18, e.g., the weighted artifact 24 can be rotated 360-degrees around the platform 20 with regard to the impact face 18. As shown in FIGS. 7-24, rotation of the weighted artifact 24 about its axis of rotation would cause a change to the center of gravity of the putter head 10 relative to the impact face 18 simultaneously along two orthogonal axes that are parallel to the bottom surface 16 and that are normal to the axis of rotation.

Figure 3:
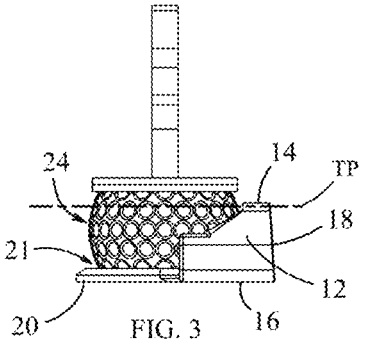
FIG. 3 is a side view of an embodiment of a putter head according to the present invention.

FIG. 3 is a side view of the first embodiment of the putter head according to the present invention. The weighted artifact 24 is designed to extend above the top plane TP of the impact face 18, which places a portion of the weight added to the putter head 10 by the weighted artifact 24 above the top surface 14 of the body 12.

Figure 4:
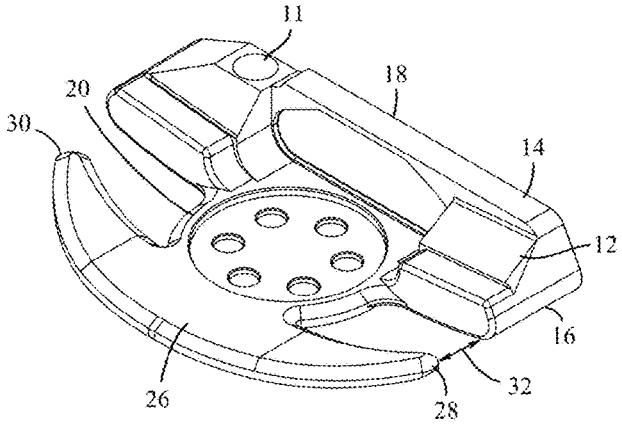
FIG. 4 is a perspective rear view of an embodiment of a winged-blade putter head according to the present invention.
Figure 5:
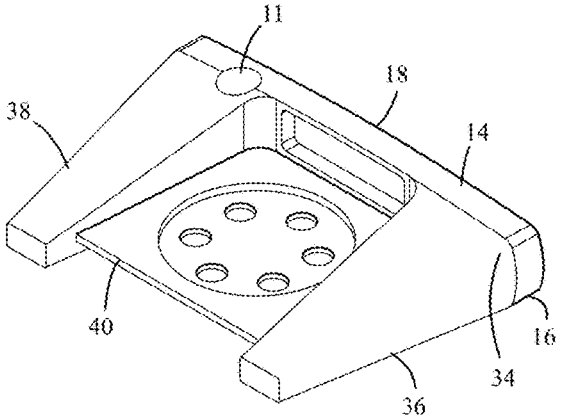
FIG. 5 is a perspective rear view of an embodiment of mallet putter head according to the present invention.
Figure 6:
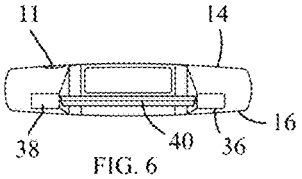
FIG. 6 is a rear view of the mallet putter head shown in FIG. 5.

The putter head 10 according to the present invention may assume a variety of different body styles. FIGS. 1-3 illustrate a hybrid-blade body 12 style for the putter head 10. FIGS. 4 through 6 illustrate alternative body styles of the putter head 10 according to the present invention.

FIG. 4 is a rear perspective view of an embodiment of a putter head having a winged-blade body design. FIG. 5 is a rear perspective view of an embodiment of a putter head having a mallet body design. FIG. 6 is a back view of the mallet body design shown in FIG. 5. The putter heads shown in FIGS. 4-6 are substantially similar to that shown in FIGS. 1 through 3 and thus each include a top surface 14, a bottom surface 16, an impact face 18 formed between the top surface 14 and the bottom surface 16, and a platform 20 extending in the direction opposite from the impact face 18.

The putter head shown in FIG. 4 includes a hybrid-blade body 12 with the platform 20 extending substantially perpendicular to the impact face 18. A wing 26 extends from the back side of the platform 20. The wing 26 is preferably integrally formed with the platform 20. The wing 26 extends between a toe end 28 and a heel end 30. The wing 26 curves between the toe end 28 and the heel end 30. Preferably, each of the toe end 28 and the heel end 30 angle upward toward the top surface 14 of the body 12. Each of the toe end 28 and the heel end 30 of the wing 26 are separated from the body 12 by an air gap 32. The presence of the air gap 32 reduces the material used for the putter head 10 and thereby reduces the weight of the putter head. A weighted artifact 24, not shown in FIG. 4, is removably and rotatably attached to the platform 20 via the removable attachment means 21, as discussed further below.

The putter head shown in FIG. 5 has a mallet body 34 extending in the opposite direction from the impact face 18. The mallet body 34 is formed by two legs 36, 38 extending substantially parallel with one another. A platform 40, similar to platform 20 discussed above, is formed between the two legs 36, 38. The platform 40 is integrally formed with the legs 36, 38. In some embodiments, such as that shown by FIGS. 5-6, the platform 40 is raised above the bottom surface 16. In alternative embodiments, the platform 40 may be coplanar with the bottom surface 16 extending between the two legs 36, 38.

In the following discussion, it should be understood that the previous putter head body styles, e.g., hybrid-blade shown in FIGS. 1-3, the winged-blade style shown in FIG. 4, and the mallet style shown in FIG. 5-6, may be generally referred to as putter head 10 having a body 12. The following discussion thus is meant to apply generally to each of the three previously described putter head body styles. For sake of simplicity, only the hybrid-blade body is depicted throughout the following drawings but it should be understood that the features described in the following paragraphs may be equally applied to any of the other putter head body styles described above.

Figure 7:
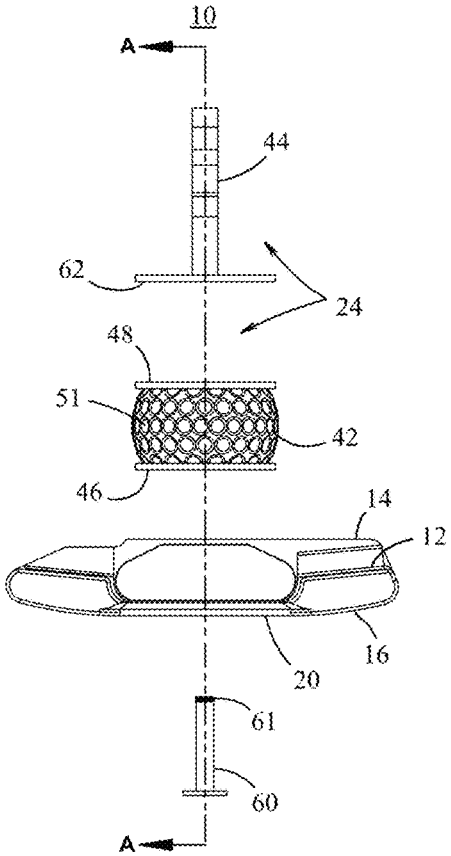
FIG. 7 is an exploded rear view of a putter head having a first embodiment of a removable attachment means for a weighted artifact according to the present invention.
Figure 8:
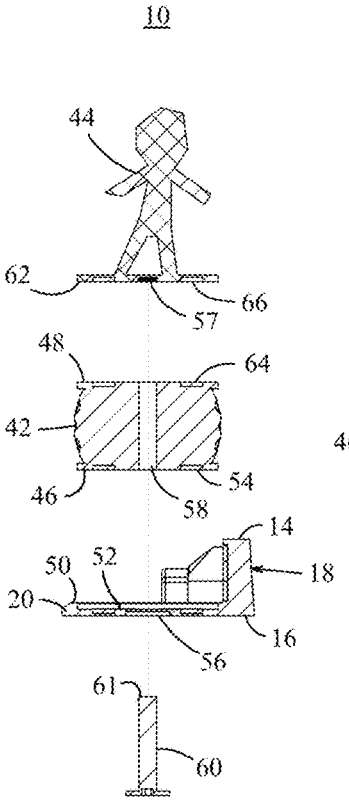
FIG. 8 is an exploded cross-sectional view, taken along line A-A, of the putter head shown in FIG. 7.
Figure 9:
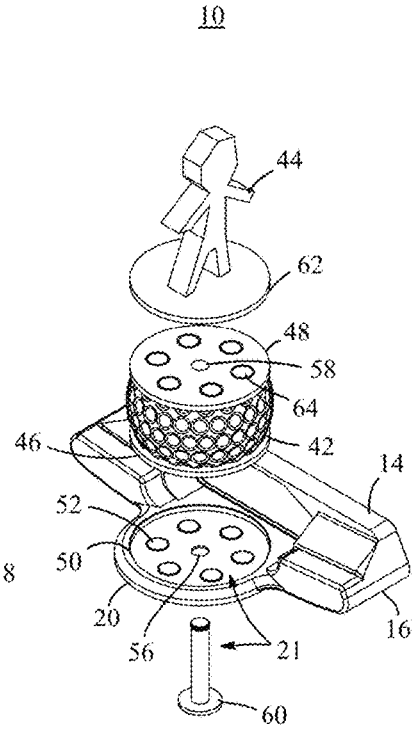
FIG. 9 is an exploded perspective view of the putter head shown in FIG. 7.

FIGS. 7 through 9 are various views of a putter head 10 having a first embodiment of the removable attachment means 21. FIG. 7 is an exploded side view of a putter head 10; FIG. 8 is an exploded side cross-sectional view, taken along lines A-A; and FIG. 9 is an exploded perspective view of the same putter head. In some embodiments, the weighted artifact 24 includes a base 42 and an ornament 44. The base 42 and the ornament 44 in some embodiments are separate pieces that are removably coupled together. In alternative embodiments, the base 42 and the ornament 44 are a single piece forming the weighted artifact 24, e.g., the ornament 44 is integrally formed with the base 42 as a single piece.

The base 42 includes a bottom surface 46 and a top surface 48. In some embodiments, such as those shown in FIGS. 7-9, the base 42 may be substantially spherical and includes dimples 51 formed in the outer surface to give the appearance of a golf ball. The bottom and top surfaces 46, 48 are preferably planar and designed to be complementary with the platform 20 and the ornament 44.

In some preferred embodiments, the platform 20 includes a lip 50 formed around the outer perimeter thereof and which defines a depth. The removable attachment means 21 for attaching the weighted artifact 24 to the platform 20 may include a plurality of magnets. Preferably, the platform 20 includes a first set of magnets 52 embedded in the platform 20 and arranged within perimeter of the lip 50. Similarly, the bottom surface 46 of the base 42 includes a second set of magnets 54 arranged to mirror the first set of magnets 52 allowing the weighted artifact 24 to be magnetically attached to the platform 20. The mirrored arrangement of the first and second sets of magnets 52, 54 also allows the weighted artifact 24 to be rotated around the platform 20 relative to the impact face 18. In one embodiment, the first set 52 and second set 54 of magnets each include six magnets radially symmetrically arranged, which allows the weighted artifact 24 to be rotated in 60-degree increments about the platform 20. In alternative embodiments, there may be more or less than six magnets to provide for more discreet or larger increments of rotation for the weighted artifact 24 around the platform 20 relative to the impact face 18.

The platform 20 may also include one or more apertures 56 defined through the platform and configured to align with one or more apertures 58 defined through the base 42. The base aperture 58 may include internal threads that are complementary to the external threads 61 of a screw 60. The weighted artifact 24 may be locked onto the platform 20 by a screw 60 threadably engaged with the complementary apertures 56, 58. The screw 60 may form part of the removable attachment means 21. Preferably, complementary apertures 56 and 58 are arranged at the center of the platform 20.

When discussing two or more apertures, e.g., apertures 56 and 58, being arranged complementary to one another, it should be understood that this is meant to convey that a single fastener, such as screw 60, is extendable through and engageable with the complementary apertures.

In some embodiments, the ornament 44 is removable from the top surface 48 of the base 42. The ornament 44 may include an ornament base 62 that is complementary to the top surface 48 of the base 42. In some embodiments, the top surface 48 may include a plurality of magnets 64 embedded therein and arranged to mirror a plurality of magnets 66 embedded in the ornament base 62 to facilitate a magnetic connection between the base 42 and the ornament 44. The ornament 44 may further include a threaded aperture 57 defined in the ornament base 62. The threaded aperture 57 is similarly arranged to be complementary to the apertures 56, 58 defined through the platform 20 and base 42 to facilitate receiving the screw 60 therethrough. The threaded aperture 57 engages the threaded end 61 of the screw 60 to secure the weighted artifact 24 to the platform 20 in addition to the magnetic connection provided by the removable attachment means 21. The screw 60, when engaged through the platform 20 and into the weighted artifact 24, is flush with the bottom surface 16 of the putter head 10.

Figure 10:
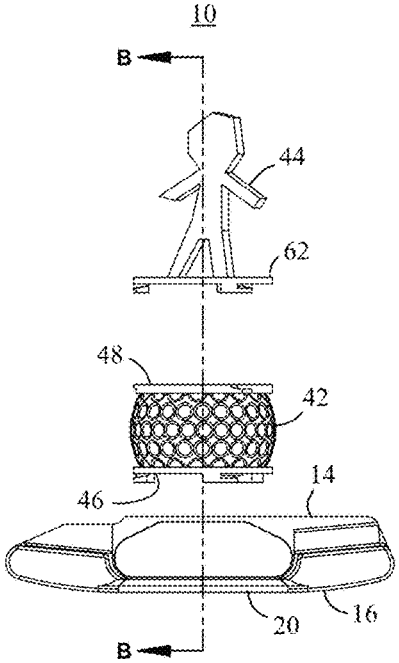
FIG. 10 is an exploded rear view of a putter head having a second embodiment of a removable attachment means for a weighted artifact according to the present invention.
Figure 11:
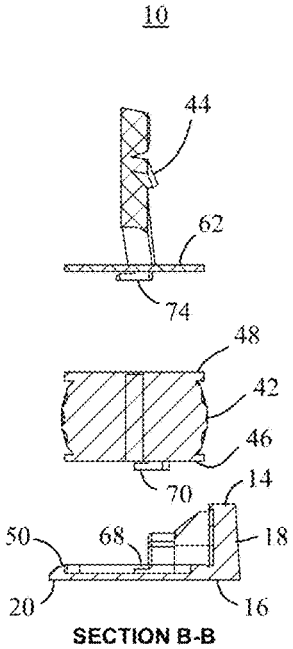
FIG. 11 is an exploded cross-sectional view, taken along line B-B, of the putter head shown in FIG. 10.
Figure 12:
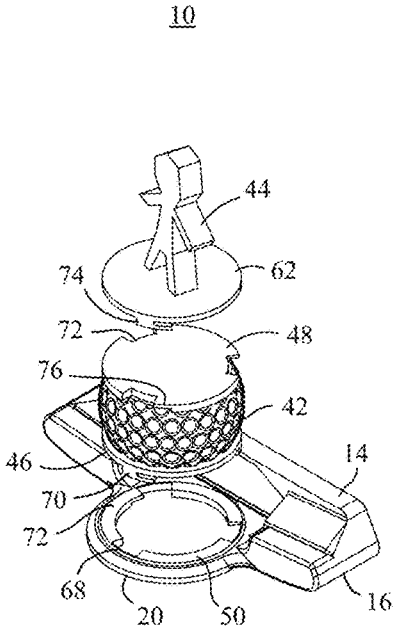
FIG. 12 is an exploded perspective view of the putter head shown in FIG. 10.

FIGS. 10 through 12 are various views of a putter head 10 according to the present invention having an alternative embodiment of the removable attachment means 21. Many of the same features described above are present in the following embodiments. Thus, the putter head 10 has a platform 20 extending from the body 12 in the direction opposite from the impact face 18. The weighted artifact 24 includes a base 42 and an ornament 44. The base 42 has a bottom surface 46 designed to interface with the platform 20 via the removable attachment means 21 and a top surface 48 configured to engage the ornament 44. The base 42 and ornament 44 may be removably coupled together or formed as a single piece where the ornament 44 is integrated with the base 42.

In some embodiments, such as those depicted among FIGS. 10-12, the removable attachment means 21 is formed as a bayonet connection or twist-lock interface. The platform 20 includes the lip 50 formed around the perimeter thereof. The lip 50 includes one or more slots 68 designed to interface with one or more arms 70 extending from the bottom surface 46 of the base 42. The arms 70 are arranged to be complementary with the slots 68 to allow the base 42 to lock onto the platform 20. The removable attachment means 21 is thus designed so that once the base 42 is positioned on the platform 20 and the arms 70 are arranged within the slots 68, the base 42 is locked onto the platform 20 by rotating the base 42 causing the arms 70 to move under the ledge 72 created by the slots 68 within the lip 50 of the platform.

In some preferred embodiments, there are three slots 58 and three arms 70, each arranged radially every 120-degrees around the diameter, to allow the weighted artifact 24 to be rotated relative to the impact face 18 in 120-degree increments. In alternative embodiments, there may be more or fewer than three slots 68 and arms 70 to provide the weighted artifact 24 with larger or smaller increments of rotation relative to the impact face 18.

In some embodiments where the ornament 44 is removable from the base 42, the ornament 44 and base 42 utilize the same configuration of removable attachment means 21 that provides for the weighted artifact 24 to attach to the platform 20. The top surface 48 of the base 42 may therefore include one or more secondary slots 72 formed around the outer perimeter thereof. The ornament base 62 similarly includes one or more secondary arms 74 extending downward and arranged to be complementary with the secondary slots 72. The locking interaction is similar to that described above. The ornament 44 is positioned on the top surface 48 of the base 42 with the secondary arms 74 arranged in the secondary slots 72. The ornament 44 is thereafter rotated relative to the base 42 causing the arms 74 to be locked under the one or more secondary ledges 76 formed by the slots 72. There may be three secondary slots 72 and secondary arms 74 to provide 120-degree increments of rotation of the ornament 44 around the base 42 relative to the impact face 18.

In preferred embodiments, the ornament 44 attaches to the base 42 in the same manner that the base 42 attaches to the platform 20. This allows a player to remove the base 42 component from the weighted artifact 24 and only use the ornament 44 as the weighted artifact 24 attached to the putter head 10. The usage of ornament 44 alone (i.e. without the base) alters the weight distribution of the putter head 10 and provides for added weight above the top surface 14. The weight distribution of the putter head 10 may be further modified using only the ornament 44 based on the relative orientation of the ornament 44 with regard to the impact face 18. In some embodiments where the ornament 44 is asymmetrical, the weight distribution for the putter head 10 may be altered depending on the orientation of the asymmetrical weighted artifact 24, i.e., ornament 44, relative to the impact face 18.

Figure 13:
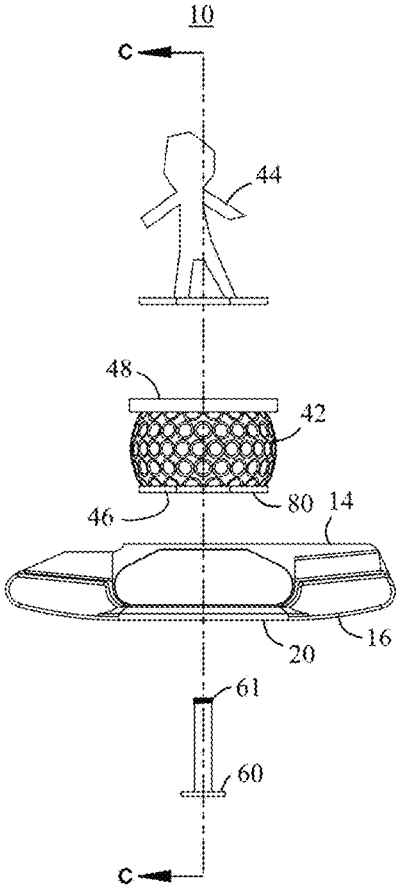
FIG. 13 is an exploded rear view of a putter head having a third embodiment of a removable attachment means for a weighted artifact according to the present invention.
Figure 14:
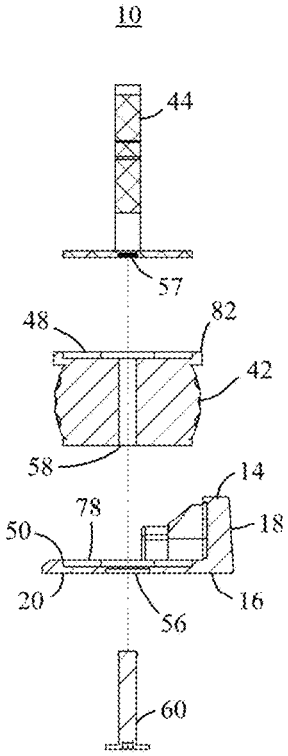
FIG. 14 is an exploded cross-sectional view, taken along line C-C, of the putter head shown in FIG. 13.
Figure 15:
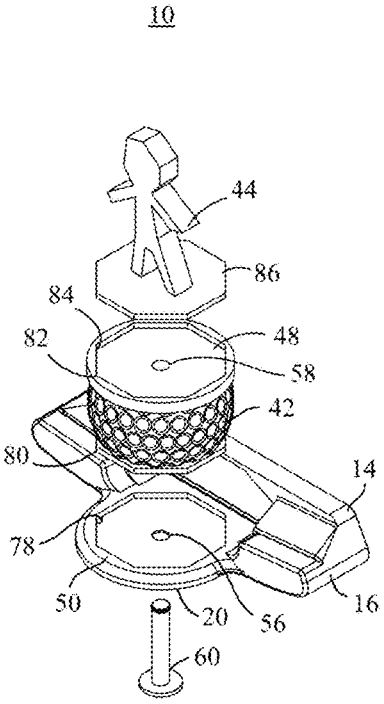
FIG. 15 is an exploded perspective view of the putter head shown in FIG. 13.

In further embodiments, the removable attachment means 21 may be designed as a geometric friction-fit with one or more optional screws to provide for added strength to the connection. FIGS. 13-15 are various views of the putter head 10 according to the present invention having an alternative embodiment of the removable attachment means 21. FIG. 13 is an exploded rear view; FIG. 14 is an exploded cross-sectional view, taken along lines C-C; and FIG. 15 is an exploded perspective view. Many of the same features described above are present in the following embodiments. Thus, the putter head 10 has a platform 20 extending from the body 12 in the direction opposite from the impact face 18. The weighted artifact 24 includes a base 42 and an ornament 44. The base 42 has a bottom surface 46 designed to interface with the platform 20 via the removable attachment means 21 and a top surface 48 configured to engage the ornament 44. The base 42 and ornament 44 may be removably coupled together or formed as a single piece where the ornament 44 is integrated with the base 42.

In the embodiments illustrated by FIGS. 13 to 15, the removable attachment means 21 is designed as a geometric friction-fit. As such, the platform 20 includes a lip 50 that frames a geometric interface 78 that is configured to receive a complementary geometric base 80 formed by the bottom surface 46 of the base 42. In the depicted embodiment, the geometric interface 78 and the geometric base 80 are formed as complementary octagonal faces but it should be understood that any other conventional or unconventional geometric shape may be used to form the complementary faces. The geometric base 80 is designed to frictionally-fit within the geometric interface 78 to secure the base 42 to the platform 20. In the illustrated embodiment having complementary octagonal faces, the player may rotate the base 42 around the platform 20 in increments of 45-degrees relative to the impact face 18.

In embodiments where the ornament 44 is removable from the base 42, there is a similar attachment interface provided therebetween. The top surface 48 of the base 42 thus may include a lip 82 that frames a geometric top 84 that is configured to interface with a geometric ornament base 86. In preferred embodiments, the attachment interface between the ornament 44 and the base 42 has the same configuration as the removable attachment means 21 provided to attach the weighted artifact 24 to the platform 20. Thus, in the illustrated embodiments, the geometric top 84 and the geometric ornament base 86 are formed as complementary octagonal faces similar to those provided between the geometric base 80 and the geometric interface 78. The ornament 44 may thus be rotated around the top surface 48 of the base 42 relative to the impact face 18 in increments of 45-degrees.

In some embodiments, the friction-fitment between the geometric base 80 and the geometric interface 78 is sufficient to reliably attach the weighted artifact 24 to the platform 20. In some alternative embodiments, the platform 20 includes one or more apertures 56 defined therethrough and arranged to be complementary with one or more apertures 58 defined in the complementary base 42. The base aperture 58 may include internal threads that are complementary to threads 61 formed on screw 60. Similar to that described above, a screw 60 may be threadably engaged through the complementary apertures 56, 58 to secure the weighted artifact 24 to the platform 20.

In embodiments where the ornament 44 is removable from the base 42, the ornament 44 may include a threaded aperture 57 formed in the geometric ornament base 86 and arranged to be complementary to apertures 56, 58. In such embodiments, the screw 60 extends through apertures 56 and 58 and threadably engages with the threaded aperture 57 to secure the weighted artifact 24 onto the platform 20. In other embodiments, more than one screw 60 may be provided and more than one set of complementary apertures are defined through each of the platform 20, the base 42, and the ornament 44 to provide a more secure locking of the components to the putter head 10.

Figure 16:
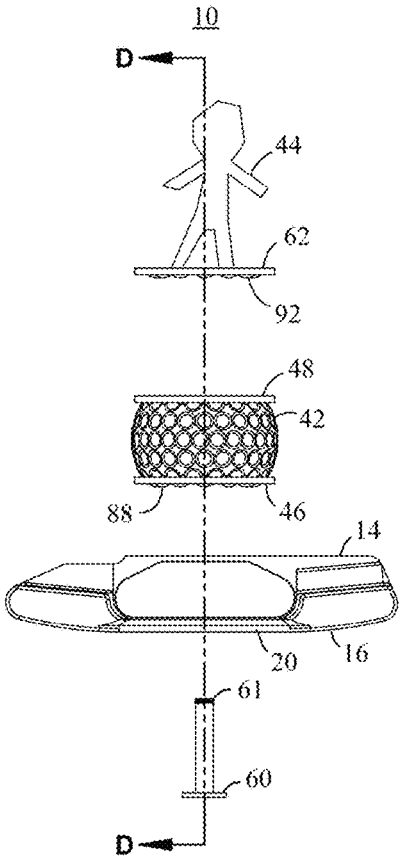
FIG. 16 is an exploded rear view of a putter head having a fourth embodiment of a removable attachment means for a weighted artifact according to the present invention.
Figure 17:
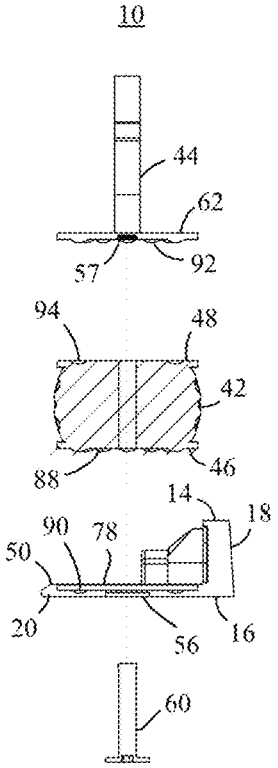
FIG. 17 is an exploded cross-sectional view, taken along line D-D, of the putter head shown in FIG. 16.
Figure 18:
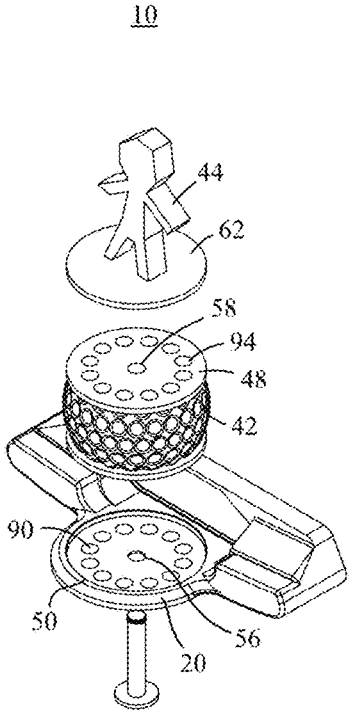
FIG. 18 is an exploded perspective view of the putter head shown in FIG. 16.

In further embodiments, the removable attachment means 21 may be designed as a series of complementary dimples and bosses. FIGS. 16 through 18 are various view of the putter head 10 having an alternative embodiment of the removable attachment means 21. FIG. 16 is an exploded rear view; FIG. 17 is an exploded cross-sectional view, taken along lines D-D; and FIG. 18 is an exploded perspective view. Many of the same features described above are present in the following embodiments. Thus, the putter head 10 has a platform 20 extending from the body 12 in the direction perpendicular to the impact face 18. The weighted artifact 24 includes a base 42 and an ornament 44. The base 42 has a bottom surface 46 designed to interface with the platform 20 via the removable attachment means 21 and a top surface 48 configured to engage the ornament 44. The base 42 and ornament 44 may be removably coupled together or formed as a single piece where the ornament 44 is integrated with the base 42.

The embodiments illustrated by FIGS. 16-18 have a removable attachment means 21 formed as a series of complementary dimples and bosses. As such, the bottom surface 46 of the base 42 includes a plurality of bosses 88 that are arranged complementary to a plurality of dimples 90 formed in the platform 20. Preferably, the plurality of dimples 90 are formed within the perimeter of the lip 50 on the platform 20. Similar to previous embodiments, the platform 20 and the base 42 may include complementary apertures 56 and 58 configured to receive a threaded screw 60 to secure the weighted artifact 24 onto the platform 20. The weighted artifact 24 may be first set in its desired position relative to the impact face 18 and the screw 60 thereafter tightened to lock the bosses 88 into the dimples 90. The base aperture 58 may include internal threads that are complementary to threads 61 on the screw 60.

In embodiments where the ornament 44 is removable from the base 42, the ornament 44 is provided with an ornament base 62 having a plurality of secondary bosses 92 formed in the bottom surface thereof and arranged to be complementary to a plurality of secondary dimples 94 formed in the top surface 48 of the base 42. The ornament 44 may include a threaded aperture 57, similar to that described above, that is aligned with apertures 56, 58 to receive the screw 60. Threaded engagement of the screw 60 in the threaded aperture 57 serves to secure the weighted artifact 24 onto the platform 20. To facilitate rotation of the base 42, the ornament 44, or the entire weighted artifact 24 (i.e., both the ornament 44 and the base 42), the screw 60 is loosened or removed, allowing the player to rotate the piece relative to the impact face 18 prior to reinstalling the screw 60 to secure the components together.

In alternative embodiments, the bosses may be formed in the platform 20 and the dimples formed in the bottom surface 46 of the base 42. Similarly, the ornament base 62 may include the secondary dimples while the top surface 48 of the base 42 includes the secondary bosses.

In the previously described embodiments, the screw 60 was an optional component of the removable attachment means 21 and was preferably arranged for installation from a center of the platform 20 and corresponding weighted artifact 24. The friction-fitment between the bottom surface 46 of the base 42 with the platform 20, along with the additional features of the removable attachment means 21 discussed previously, may be sufficient to attach the weighted artifact 24 to the platform 20. The screw 60 is utilized to strengthen the connection of the weighted artifact 24 with the platform 20 but is not necessary to accomplish attachment of the weighted artifact 24 to the platform 20. A player may desire the addition of the screw 60, regardless of the embodiment of the removable attachment means 21 provided, given that it is normal for golf clubs to bounce around in a player's bag during play and during transit. Typically, golf clubs, including the putter, are loosely stored in a golf bag and tend to bounce around and bang into each other throughout the round of golf. The addition of the screw 60 in combination with the removable attachment means 21 ensures that the weighted artifact 24 does not disengage from the platform 20 during transit to and on a course.

In some simpler embodiments, the removable attachment means 21 is formed simply as two or more screws that extend through the platform 20 and into the weighted artifact 24.

Figure 19:
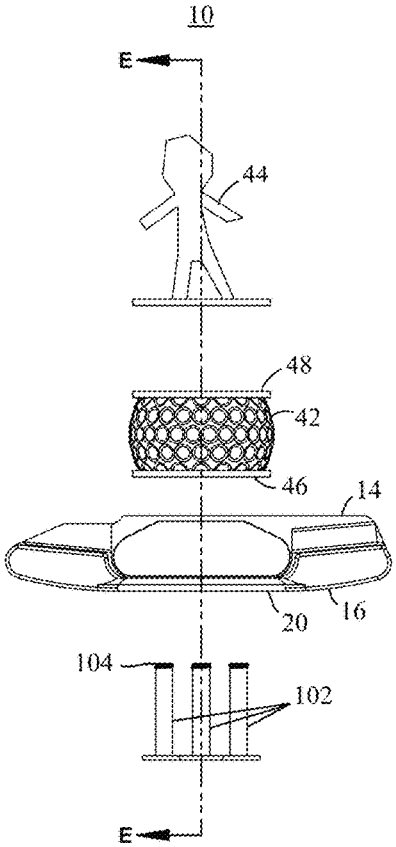
FIG. 19 is an exploded rear view of a putter head having a fifth embodiment of a removable attachment means for a weighted artifact according to the present invention.
Figure 20:
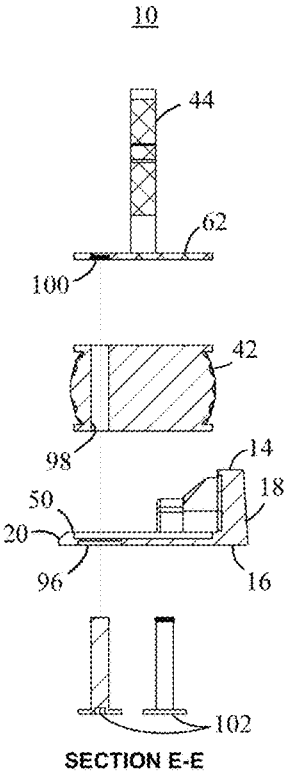
FIG. 20 is an exploded cross-sectional view, taken along line E-E, of the putter head shown in FIG. 19.
Figure 21:
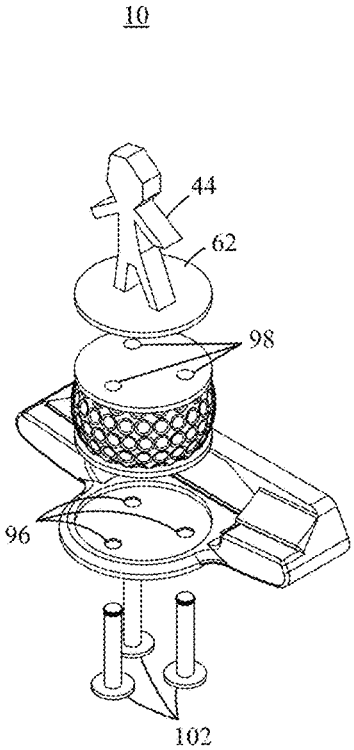
FIG. 21 is an exploded perspective view of the putter head shown in FIG. 19.

FIGS. 19 through 21 are various view of a putter head 10 having an alternative embodiment of the removable attachment means 21. FIG. 19 is an exploded rear view; FIG. 20 is an exploded cross-sectional view, taken along lines E-E; and FIG. 21 is an exploded perspective view. In the embodiment of the putter head 10 illustrated among FIGS. 19-21, the removable attachment means 21 is designed as two or more removable screws. In the illustrated embodiment, there are three screws being utilized for the removable attachment means 21. Preferably, the platform 20 includes two or more apertures 96 defined through the platform 20 and arranged within the perimeter formed by the lip 50. Similarly, the base 42 includes two or more apertures 98 defined therethrough and arranged to be complementary to the apertures 96 defined through the platform 20. In embodiments, such as the one shown, where the ornament 44 is removable from the base 42, a similar number of threaded apertures 100 are formed in the bottom surface of the ornament base 62 and arranged to be complementary to apertures 96 and 98. A corresponding number of screws 102 are thereafter used to secure the weighted artifact 24 to the platform 20. The screws 102 have a length sufficient to reach the threaded apertures 100 in the ornament base 62 when the weighted artifact 24 is assembled onto the platform 20. When so engaged, the screws 102 are flush with the bottom surface 16 of the platform 20 so as to not impede or otherwise interfere with the player's putting stroke.

In some preferred embodiments, the screws 102 are specially designed for use with the putter head 10 and only have threads 104 at the terminal end to engage with the threaded apertures 100 formed in the ornament base 62. The apertures 96 and 98 defined through the platform 20 and base 42 are simply holes, with no threading present therein. In embodiments where the ornament 44 is integrated with the base 42, the apertures 98 formed in the base may extend less than fully through the base 42 and include the internal threads to engage the screws 102. The screws 102 used in such embodiments need only have a length sufficient to reach the internal threads formed in apertures 98 of the base 42. The screws 102 are preferably flush with the bottom surface 16 when so engaged.

The number of apertures 96, 98 and 100 defined in each of the platform 20, the base 42 and the ornament 44, respectively, correspond to one another so that if the platform 20 includes three apertures 96 (as shown), each of the base 42 and the ornament 44 include a corresponding three apertures 98 and 100. The apertures 96, 98, and 100 are arranged to be complementary to one another. In preferred embodiments utilizing three of each aperture 96, 98, 100, it is preferred that the apertures are radially separated by about 120-degrees around the perimeter of the platform 20, the bottom surface 46 and the ornament base 62. This provides the player the opportunity to rotate the weighted artifact 24 around the platform 20 relative to the impact face 18 in increments of 120-degrees. In other embodiments, there may be more or less than three apertures to provide for smaller or larger increments of rotation.

Figure 22:
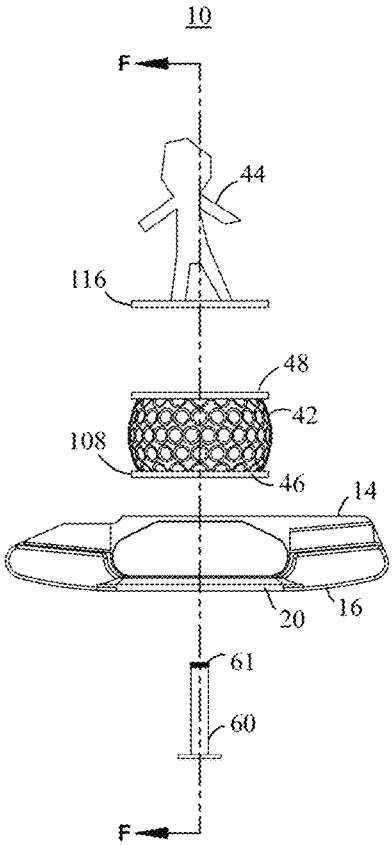
FIG. 22 is an exploded rear view of a putter head having a sixth embodiment of a removable attachment means for a weighted artifact according to the present invention.
Figure 23:
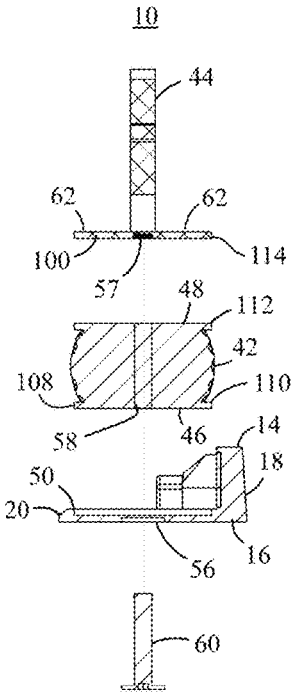
FIG. 23 is an exploded cross-sectional view, taken along line F-F, of the putter head shown in FIG. 22.
Figure 24:
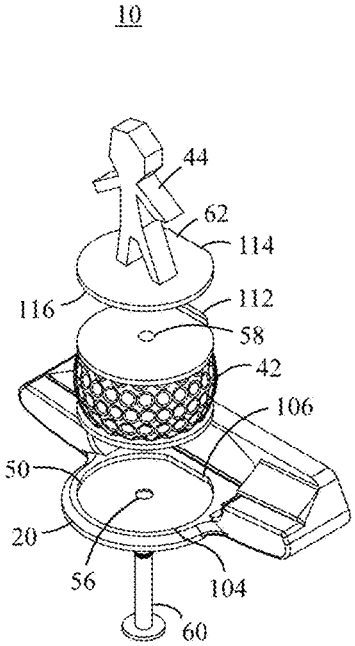
FIG. 24 is an exploded perspective view of the putter head shown in FIG. 22.

In further embodiments of the putter head 10 according to the present invention, the removable attachment means 21 may prevent rotation of the weighted artifact 24 relative to the impact face 18. In such embodiments, the weighted artifact 24 may interface with the platform 20 in only one position and cannot be rotated thereabout. FIGS. 22 through 24 are various views of the putter head 10 having an embodiment of a non-rotatable removable attachment means 21. FIG. 22 is an exploded rear view; FIG. 23 is an exploded cross-sectional view, taken along lines F-F; and FIG. 24 is an exploded perspective view. The platform 20 forms a non-circular interface 104 that includes a notch 106 formed in the lip 50. The perimeter 108 of the bottom surface 46 of the base 42 is formed with a flat section 110 that is complementary to the notch 106 formed in the lip 50 of the platform 20. Thus, the base 42 fits to the platform 20 by aligning the flat section 110 with the notch 106. The base 42 is preferably friction-fit to the platform 20 upon alignment of the flat section 110 and the notch 106.

An optional screw 60, such as that described previously, may be used to further secure the base 42 to the platform 20. In such embodiments, similar to those previously described, there is an aperture 56 defined through the platform 20 and a complementary aperture 58 defined in the base 42. In some embodiments where the ornament 44 is removable from the base 42, there is a threaded aperture 57 formed in the ornament base 62. The threaded aperture 57 engages threads 61 of the screw 60 to secure the weighted artifact 24 to the platform 20. Alternatively where the ornament 44 is integral with the base 42, the aperture 58 may include internal threads to engage the screw 60. Preferably, the screw 60, when fully engaged, is flush with the bottom surface 16 of the platform 20.

In embodiments where the ornament 44 is removable from the base 42, the top surface 48 of the base 42 includes an edge protrusion 112 extending upward therefrom. The ornament base 62 includes a flat section 114 formed in the perimeter 116 thereof. The flat section 114 is complementary to the edge protrusion 112. With a proper alignment between the flat section 114 and the edge protrusion 112, the apertures 56, 58 align with the threaded aperture 57 to receive the screw 60 therethrough. Given that the proper alignment among the platform 20, the base 42 and the ornament 44 in this embodiment can only be achieved at one position, the weighted artifact 24 cannot be rotated with respect to the platform 20 relative to the impact face 18. This embodiment gives a player the least amount of customization.

In the following discussion, various embodiments of the weighted artifact 24 are disclosed. Thus far, the weighted artifact 24 includes a base 42 and an ornament 44 that may or may not be removable from the base 42. In all previously described embodiments, the ornament 44 is illustrated as being removable from the base 42 but it should be understood that any of these previously disclosed embodiments, the base 42 and ornament 44 may be formed as a single piece. The weighted artifact 24 described in the following paragraphs may be used with any of the previously disclosed embodiments of the putter head 10 according to the present invention.

Figure 25:
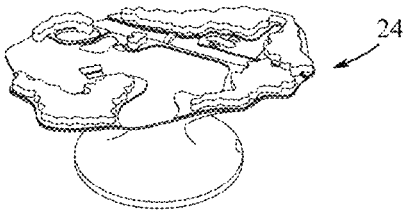
FIG. 25 is a perspective view of an alternative embodiment of a weighted artifact according to the present invention.
Figure 26:
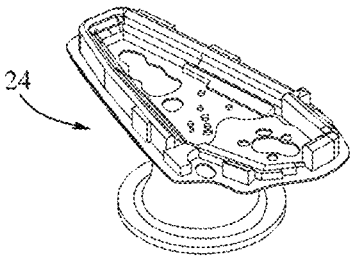
FIG. 26 is a perspective view of a further alternative embodiment of a weighted artifact according to the present invention.
Figure 27:
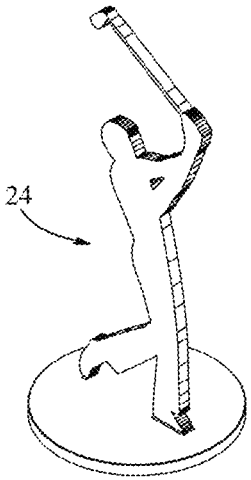
FIG. 27 is a perspective view of a further alternative embodiment of a weighted artifact according to the present invention.

FIGS. 25 through 27 are various perspective views of alternative embodiments of the weighted artifact according to the present invention. The weighted artifact 24 shown among FIGS. 25-27 may be used with any of the previously described putter heads 10. In FIGS. 25 and 26, the weighted artifact 24 is formed as a model of a golf course hole, such as the famous 12th hole at Augusta National Golf Course (FIG. 25) or the 16th hole TPC Scottsdale (FIG. 26). FIG. 27 illustrates a weighted artifact 24 in the form of a golfer sculpture.

The weighted artifact 24 may be formed as a 2-D or 3-D model of a golf course hole or a sculpture. The golf course hole model may be of a famous hole from a famous golf course, such as those shown by FIG. 25-26, or it may be any hole from any golf course. In embodiments where the weighted artifact 24 is in the form of a sculpture, the ornament may be formed as a comic book hero or villain, a middle finger, a mascot, or anything else desired by the player for customizing their putter head 10. The weighted artifact 24 may be symmetrical, so that rotation of the artifact with respect to the platform or impact face has no effect on the center of gravity of the putting head, or the weighted artifact 24 may be asymmetrical, so that a golfer may desirably alter the center of gravity of the putting head by rotating the artifact with respect to the platform or impact face. In any embodiment thus described and shown among FIGS. 7-24, it is preferred that rotation of the weighted artifact 24 about an axis of rotation would cause a change to the center of gravity of the putter head 10 relative to the impact face 18 simultaneously along the two orthogonal axes that are parallel to the bottom surface 16 and that are normal to the axis of rotation.

In some embodiments where the weighted artifact 24 is formed of the base 42 and a removable ornament 44, the base 42 may also serve as an attachment platform for various putting training aids. For instance, the center aperture 58 defined through the base 42 in some embodiments of the weighted artifact 24 may serve to mount a training device, such as a laser. Alternatively, the entire weighted artifact 24 may be formed as a training device that attaches to the platform via the removable attachment means 21, e.g., a base 42 with an integrated laser for proper alignment training. In such embodiments, the training device, e.g., laser, that is integrated to the base 42 may be described as the ornament 44.

In any of the previously described weighted artifacts 24, there may be a symmetric or asymmetric weight distribution depending on a number of factors, including the choice of materials and design of artifact provided thereby. For instance, the base 42 may enclose a plurality of weights that are asymmetrically arranged within the base. This may provide one side of the base 42 with more weight than the other sides of the base so that when the weighted artifact 24 is attached to the platform 20, the player may customize the weight distribution by rotating the weighted artifact 24 to place the heavier side closer or farther away from the impact face 18. Alternatively, the base 42 may provide for a uniform weight distribution and the customization of the weight distribution for the putter head 10 comes from rotating a removable ornament 44 about the top surface 48 of the base. Depending on the style of the removable ornament 44, the ornament 44 itself may be asymmetrically weighted so that attachment of the ornament at any position relative to the impact face 18 alters the weight distribution of the putter head 10. In further alternative embodiments, such as those shown in FIGS. 25-26, the entire weighted artifact 24 may be asymmetrical and asymmetrically weighted as a byproduct of the design chosen. Rotation of the weighted artifact 24 about an axis of rotation would cause a change to the center of gravity of the putter head 10 relative to the impact face 18 simultaneously along two orthogonal axes that are parallel to the bottom surface 16 and that are normal to the axis of rotation.

As briefly discussed above, where the ornament 44 is removable from the base 42, it is preferred that the ornament 44 be attached to the top surface 48 of the base 42 in the same manner provided by the removable attachment means 21 for attaching the base to the platform 20. Thus, in embodiments where the base 42 attaches to the platform 20 via a plurality of complementary magnets, it is preferred that the ornament 44 attach to the base 42 via a plurality of complementary magnets. This uniformity in attachment mechanisms between the platform 20, base 42, and ornament 44 allows the player to further customize their putter head 10 without requiring any additional or alternative pieces. A player may opt for attaching the entire weighted artifact 24 (i.e., base 42 plus ornament 44), only the base 42, or only the ornament 44 to the platform 20. Further, the putter head 10 remains functional without the weighted artifact 24 attached thereto and thus offers a further level of customization to the player.

Figure 28:
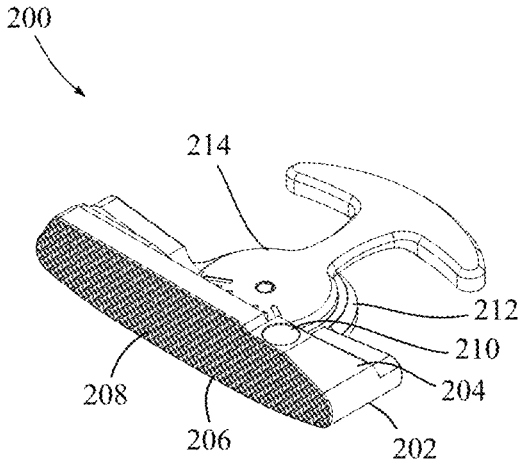
FIG. 28 is a perspective view of a further alternative embodiment of a putter head according to the present invention.

FIG. 28 is a perspective view of an alternate embodiment of a putter head according to the present invention. Putter head 200 is similar to other putter heads described herein and includes a body 202 defining a top surface 204, a bottom surface 206 and an impact face 208 extending between the top surface 204 and the bottom surface 206. The top surface 204 includes a means for engaging a putter shaft. Similar to that described above, the putter shaft engagement means 210 may be a threaded hole for threadably receiving a putter shaft or a hosel extending from the top surface 204 to receive the shaft. A platform 212 extends from the body 202. Preferably, the platform 212 is parallel with the bottom surface 206 and extends in a direction opposite the impact face 208. In preferred embodiments, putter head 200 has a pickaxe weighted artifact 214, or simply a pickaxe artifact 214, removably and rotatably attached to the platform 212. The pickaxe artifact 214 extends from the platform 212 substantially opposite the impact face 208.

Figure 29:
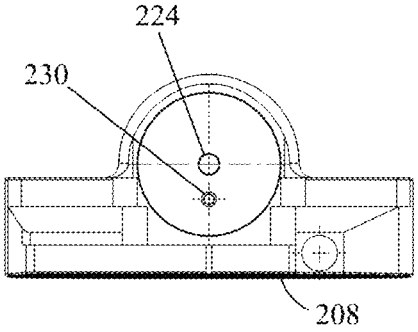
FIG. 29 is a top isolated view of the putter head shown in FIG. 28.
Figure 30:
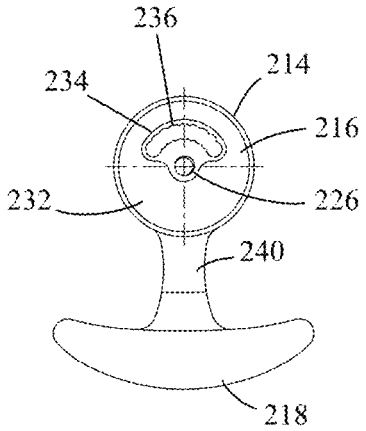
FIG. 30 is a bottom view of an embodiment of a pickaxe artifact according to the present invention.

FIG. 29 is a top view of an isolated putter head 200 and FIG. 30 is a bottom view of an embodiment of a pickaxe artifact according to the present invention. The putter head 200 includes a means for locking the pickaxe artifact 214 to the platform 212. In some preferred embodiments, the locking means includes an aperture 224 defined through the platform 212 and a threaded aperture 226 defined in the circular body 216 of the pickaxe artifact 214. The threaded aperture 226 is designed to align with the aperture 224 of the platform 212 when the pickaxe artifact 214 is installed thereon. A screw 228 is threadably engaged through the aperture 224 in the platform 212 to the threaded aperture 226. Thus, in preferred embodiments, the means for locking the artifact 214 to the platform 212 is the screw 228 extending through the aperture 224 of the platform 212 to threadably engage with the threaded aperture 226 formed in the pickaxe artifact 214.

The pickaxe artifact 214 also includes a means for rotating the artifact on the platform 212 relative to the impact face 208. In preferred embodiments, the platform 212 has at least one boss 230 extending therefrom. The boss 230 is positioned off-center, e.g., away from aperture 224. As shown in FIG. 30, the bottom surface 232 of the circular body 216 of the pickaxe artifact 214 includes an engagement channel 234 formed therein. The engagement channel 234 is designed to engage the boss 230 extending from the platform 212. In preferred embodiments, the engagement channel 234 has a plurality of locking dimples 236 each designed to engage the boss 230 to secure the pickaxe artifact 214 at a set angle relative to the impact face 208. The locking dimples 236 are equally spaced apart within the engagement channel 234 so that each locking dimple 236 corresponds to an equal degree change of the pickaxe artifact 214 relative to the impact face, e.g., each locking dimple 236 may change the set angle by 15-degrees relative to the impact face 208. The engagement channel 234 thus forms an adjustment arc that allows the player to rotate the pickaxe artifact 214 relative to the impact face 208 in set increments.

In some embodiments, the adjustment arc defined by the engagement channel 234 is between 120-degrees and 160-degrees. In alternative embodiments, the engagement channel 234 may define an adjustment arc of 180-degrees or more. However, the pickaxe artifact 214 in such embodiments requires slight modification to allow for the full 180-degree rotation. This may be accomplished by adding a base weight 238 between the pickaxe artifact 214 and the platform 212 to raise the artifact 214 above the top surface 204 of the body 202 so that the heel end 220 or the toe end 222 does not interfere with the T-shaped extension 218. In further alternatives, the arm 240 connecting the T-shaped extension 218 to the circular body 216 may be extended to provide the needed clearance from the heel end 220 and the toe end 222 for the 180-degree rotation.

Figure 31:
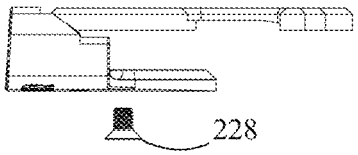
FIG. 31 is an exploded side view of the putter head shown in FIG. 28.

FIG. 31 is an exploded side view of the putter head 200. The screw 228 is sized to terminate within the threaded aperture 226.

Figure 32:
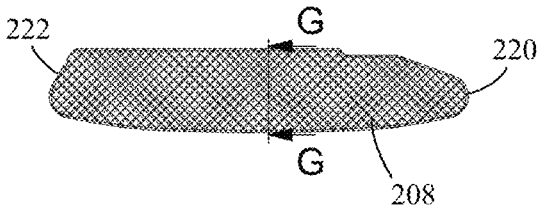
FIG. 32 is a front view of the putter head shown in FIG. 28.
Figure 33:
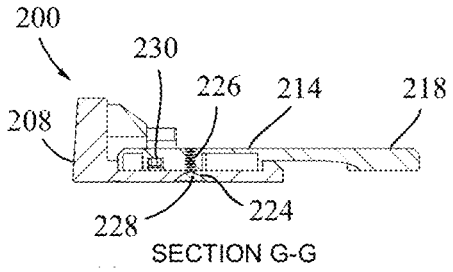
FIG. 33 is a cross-sectional view, taken along lines G-G marked in FIG. 32, of the putter head shown in FIG. 28.

FIG. 32 is a front view of the putter head 200 and FIG. 33 is a cross-sectional side view, taken along lines G-G, of the putter head 200. The threaded engagement of the screw 228 extending through the aperture 224 of the platform 212 into the threaded aperture 226 of the pickaxe artifact 214 locks the artifact 214 onto the platform 212. As briefly mentioned above, the pickaxes artifact 214 is designed to be rotated with respect to the platform 212 relative to the impact face 208. Rotation of the pickaxe artifact 214 with respect to the platform 212 is designed to allow a player to shift the T-shaped extension 218, relative to the impact face 208, between the heel end 220 and the toe end 222, as shown among FIGS. 34 to 36.

Figure 34:
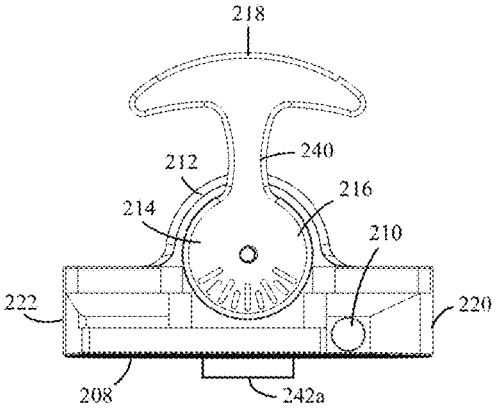
FIG. 34 is a first top view of the putter head shown in FIG. 28.

FIG. 34 is a top view of the putter head shown in FIG. 28. The pickaxe artifact 214 preferably has a circular body 216 coupled to the platform 212 with the T-shaped extension 218 extending from the circular body 216. The body 202 of the putter head 200 has a heel end 220 and a toe end 222. The heel end 220 is the end of the body 202 closest to the putter shaft engagement means 210 and the toe end 222 is the opposite end.

Figure 36:
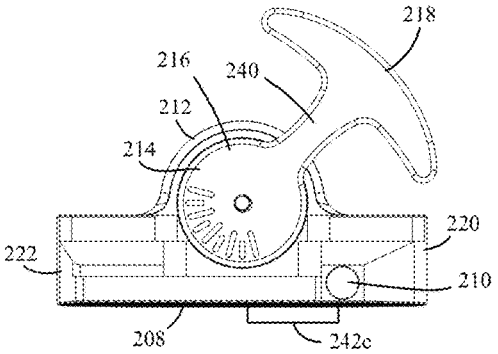
FIG. 36 is a third top view of the putter head shown in FIG. 28.
Figure 35:
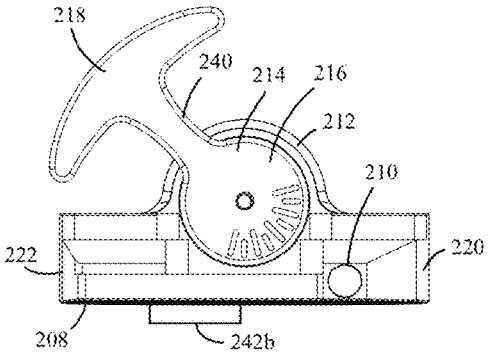
FIG. 35 is a second top view of the putter head shown in FIG. 28.

FIGS. 34 through 36 are top down views of the putter head 200 illustrating the rotatability of the pickaxe artifact 214 relative to the impact face 208. The pickaxe artifact 214 is designed to rotate on the platform 212 allowing the T-shaped extension 218 to be moved between the toe end 222 (FIG. 35) and the heel end 220 (FIG. 36). As briefly explained above with regard to FIGS. 29-30, the putter head 200 includes a means for rotatably attaching the pickaxe artifact 214 to the platform 212 at a set angle relative to the impact face 208 and a means for locking the artifact 214 to the platform 212 at the set angle.

Figure 37:
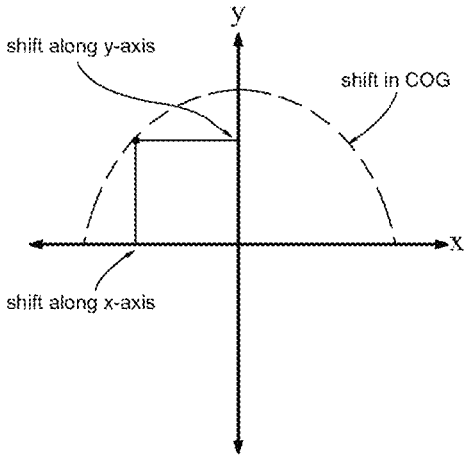
FIG. 37 is a graph illustrating a change to the center of gravity for a putter head according to the present invention, the graph showing two orthogonal axes that are parallel to the bottom surface of the putter head.

The rotatability of the pickaxe artifact 214 with respect to the platform 212 relative to the impact face 208 serves several purposes. First, as demonstrated by the graph illustrated in FIG. 37, rotation of the pickaxe artifact 214 relative to the impact face 208 causes a shift to the center of gravity ("COG") of the putter head 200 along two orthogonal axes that are parallel to the bottom surface of the putter head body and that are normal to the axis of rotation, one of which, e.g., the X-axis, is parallel to the impact face 208. This allows a player to customize the weight distribution of the putter head 200 to more closely match their putting stroke and maximize forgiveness for off-center strikes. Said another way, the rotatability of the pickaxe artifact 214 relative to the impact face 208 allows the player to shift the face balance of the putter head 200 between the heel end 220 and the toe end 222. For example, in a face balanced putter, when the putter is balanced on a single point, like a player's finger, the impact face 208 points up substantially parallel to the ground surface. In contrast, a toe balanced putter is found where, when balanced on a single point, the toe end 222 points to the ground and an angle is created between the impact face 208 and the ground. Similarly, for a heel balanced putter, the heel end 220 points to the ground surface when the putter is balanced on a single point. The putter head 200 according to the present invention allows a player to shift the face balance of the putter between the heel end 220 and the toe end 222 by adjusting the pickaxe artifact 214 along the adjustment arc defined by the engagement channel 234. Depending on the individual player's putting stroke, the putter head 200 allows for customization and selection of a face balanced putter, a toe balanced putter, and a heel balanced putter, along with incremental adjustments between the three options.

In addition to allowing for shifting of the COG and fine-tuning the face balance to match a player's putting stroke, the putter head 200 allows a player to change the moment of inertia ("MOI") to shift and expand the sweet spot of the impact face 208 between the heel end 220 and the toe end 222. The MOI of a putter head, such as putter head 200, is defined as the resistance to twisting about a primary vertical Z-axis passing through the COG and a secondary axis through the centerline of the shaft. The higher the MOI of a putter head, the more resistance there is to twisting, i.e., opening or closing, about the vertical axis and the shaft upon impact with a golf ball, particularly with off-center or non-sweet spot hits. The sweet spot of a putter head generally corresponds to the portion of the impact face proximate to the center-of-gravity of the putter head such that a strike of the golf ball within the sweet spot will produce a straight roll and the club will experience the least amount of twisting to thereby avoid imparting undesired spin on the ball. A player striking the golf ball at any spot within the sweet spot can expect a consistent result, e.g., straight roll with minimal to no spin and minimal to no club twisting.

MOI is important for putting because it is common for a player to strike the ball off-center outside the sweet spot of the impact face 208, causing the putter head to twist and the ball to roll off-line from the intended target. This reduces the distance the ball will travel and also causes a loss of directional control, i.e., causing the ball to spin off line, ultimately leading to a less effective putt. Putter head 200 allows a player to increase the MOI expanding the sweet spot of the impact face 208 between the heel end 220 and the toe end 222 by rotating the pickaxe artifact 214 between the heel end 220 and the toe end 222. Traditionally, the MOI of a putter has been increased by adding weight to the perimeter of the putter head, e.g., proximate the heel end 220 and the toe end 222 but this perimeter weighting does not allow for a player to finetune the MOI to match their specific putting stroke.

Turning back to the top down views of FIGS. 34 through 36, the different positions of the pickaxe artifact 214 relative to the impact face 208 of the putter head 200 are engineered to change the MOI, e.g., increase or decrease, while shifting and expending the sweet spot. FIG. 34 is an example of putter head 200 where a player has opted for medium MOI with a neutral sweet spot 242*a* due to positioning the pickaxe artifact 214 in a neutral position. The T-shaped extension 218 is positioned substantially parallel to the impact face 208. The putter shaft, not shown, would extend from the shaft engagement means 210, adding weight to the heel side 220. The pickaxe artifact 214, with the T-shaped extension 218 substantially parallel to the impact face 208, balances the putter head 200 to place the center of gravity more true to the center of the impact face 208 giving the putter head a neutral sweet spot 242*a*. Given the low MOI of the putter head for FIG. 34, a ball strike outside the neutral sweet spot 242*a* tends to cause the putter head 200 to twist, e.g., open or close depending on the location of the strike, resulting in the ball rolling off the target line and reducing the total travel distance. The neutral position of the pickaxe artifact 214 shown in FIG. 34 is most useful for players with minimal arc having a straight-back and straight-through putting stroke.

FIG. 35 is an example of putter head 200 where a player has opted for a high MOI with an expanded sweet spot 242*b*. The MOI in this example is increased by rotating the pickaxe artifact 214 toward the toe end 222 shifting the center of gravity and providing more weight opposite the shaft, not shown, extending from the shaft engagement means 210. The T-shaped extension 218 is rotated to be positioned at an angle relative to the impact face 208, adding more weight to the toe end 222 of the putter head 200. The toe end 222 positioning of the pickaxe artifact 214 is useful for players who have an arced putting stroke and tend to strike the ball off-center toward the toe end 222. The expanded sweet spot 242*b* provides such a player with more forgiveness, or resistance to twisting due to the higher MOI, for their off-center, toe end 222 strikes. However, heel end 220 strikes will be more unstable resulting in the undesired twisting.

In FIG. 36, the putter head 200 may be described as having a low MOI due to the majority of the weight now being focused on the heel end 220, i.e., the pickaxe artifact 214 rotated toward the heel end 220 and the shaft extending from means 210. The COG of the putter head 200 with the pickaxe artifact 214 rotated toward the heel end 220 is shifted toward the heel end 220 along with the sweet spot 242*c*. Further, given the concentration of weight toward the heel end 220, the sweet spot 242*c* is reduced as well as shifted toward that end when compared to that provided by the pickaxe artifact 214 position shown in FIG. 35. The heel end 220 position of the pickaxe artifact 214 may be advantageous for players who tend have an open face to closed face putting stroke.

The putter head 200 allows a player to experiment and finetune the MOI and position of the sweet spot 242*a-c* to arrive at a weight distribution that optimizes the effectiveness for their individual putting stroke. If the player knows he consistently strikes toward the toe end 222 of the impact face 208, the player can experiment with rotating the pickaxe artifact 214 between the neutral position shown in the FIG. 34 and the toe end 222 position shown in FIG. 35 until arriving at the exact position to optimize his stroke. Similarly, for a player known to strike the heel end 220 of the impact face 208, the player can experiment with rotating the pickaxe artifact 214 between the neutral position (FIG. 34) and the heel end 220 position shown in FIG. 36 until arriving at the position to optimize his stroke. The plurality of locking dimples 236 formed within the engagement channel 234 provides the player with multiple discrete positions of the pickaxe artifact 214 to rotate the T-shaped extension 218 between the heel end 220 and the toe end 222 relative to the impact face 208 to finetune the putter head 200 to match their stroke. Once the player has determined the most desired position of the pickaxe artifact 214 to optimize the effectiveness of his putting stroke, the screw 228 can be installed to lock the artifact in position on the platform 212 via threaded engagement with the threaded aperture 226 thereof.

Figure 38:
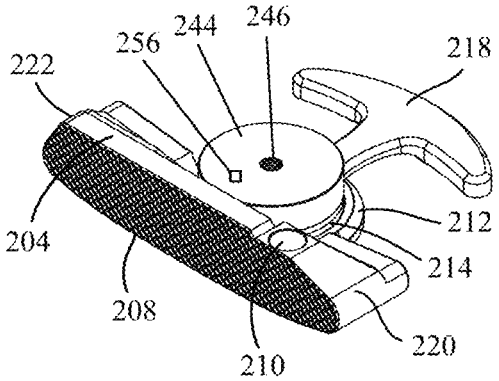
FIG. 38 is a perspective view of a further alternative embodiment of a putter head according to the present invention.
Figure 39:
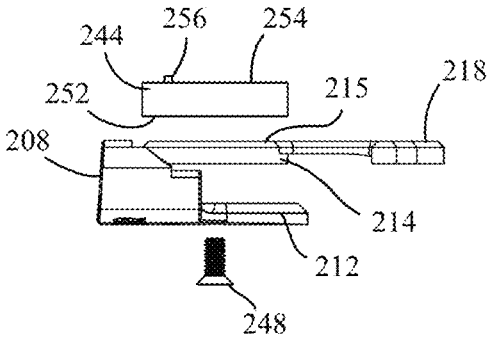
FIG. 39 is an exploded side view of the putter head shown in FIG. 38.

FIG. 38 is a perspective view of an embodiment of a putter head having a puck weight attached thereto. FIG. 39 is an exploded side view of the putter head shown in FIG. 38. In some embodiments of the putter head 200, a puck weight 244 can be attached to the circular body 216 of the pickaxe artifact 214 to add to the total weight of the putter head 200. In some embodiments, the puck weight 244 is attached to the top surface 215 of the circular body 216, as shown in FIGS. 38 and 39. In alternative embodiments, discussed below with regard to FIGS. 41-43, the puck weight 244 can be attached between the platform 212 and the pickaxe artifact 214.

The puck weight 444 includes a centrally located threaded aperture 246 designed to align with the threaded aperture 226 of the pickaxe artifact 214. An extended screw 248 may be used to lock the puck weight 244 and the pickaxe artifact 214 to the platform 212 after the desired position of the T-shaped extension 218 has been set by the player, as discussed above.

Figure 40:
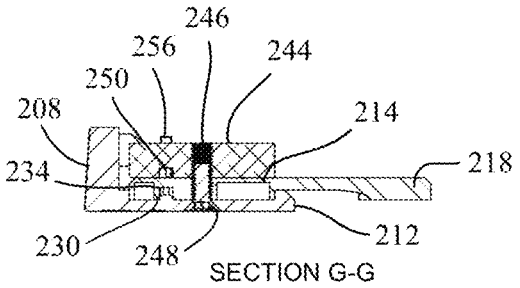
FIG. 40 is a side cross-sectional view, taken along lines G-G marked in FIG. 32, of the putter head shown in FIG. 38.

FIG. 40 is a cross-sectional view, taken along lines G-G marked in FIG. 32, of an embodiment of the putter head 200 with a puck weight 244 attached thereto. As can be seen, the extended screw 248 locks the puck weight 244 and the pickaxe artifact 214 onto the platform 212. The pickaxe artifact 214 engages the platform 212 in the manner described above to allow a player to rotatably adjust the artifact to a desired location between the heel end 220 and the toe end 222 to optimize the effectiveness of the weight distribution to match their putting stroke.

Figure 41:
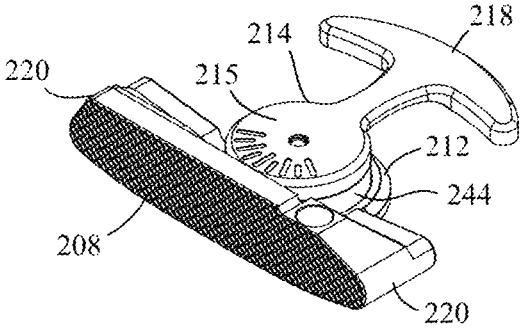
FIG. 41 is a perspective view of a further embodiment of a putter head according to the present invention.
Figure 42:
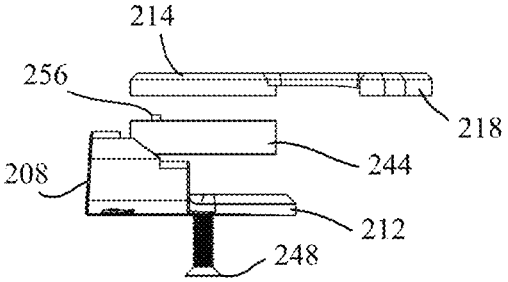
FIG. 42 is an exploded side view of the putter head shown in FIG. 41.
Figure 43:
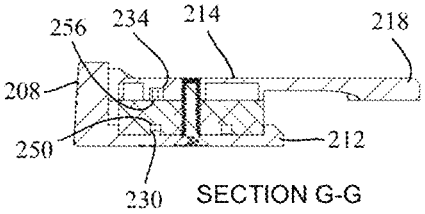
FIG. 43 is a side cross-sectional view, taken along lines G-G marked in FIG. 32, of the putter head shown in FIG. 41.

FIG. 41 is a perspective view of an alternative configuration of the puck weight 244 being attached to a putter head 200. FIG. 42 is an exploded side view of FIG. 41 and FIG. 43 is a cross-sectional side view, taken along lines G-G marked in FIG. 32, of the embodiment shown in FIGS. 41-42. In preferred embodiments, the puck weight 244 includes a dimple 250 formed in its bottom surface 252 and a boss 256 extending from its top surface 254. The dimple 250 and the boss 256 are vertically aligned with the boss 230 extending from the platform 212. When the puck weight 244 is simply attached to the top surface of the pickaxe artifact 214, as shown in FIGS. 38-40, the dimple 250 and boss 256 are not used. However, when the puck weight 244 is attached between the platform 212 and the pickaxe artifact 214, the dimple 250 engages the boss 230 extending from the platform 212 to secure the puck weight 244 in position. The boss 256 extending from the top surface 254 of the puck weight 244 engages one of the locking dimples 236 formed within the engagement channel 234 of the pickaxe artifact 214 to maintain the rotatability of the pickaxe artifact 214 as described above. The puck weight 244 raises the pickaxe artifact 214 off the platform 212 while maintaining the functionality thereof and adding weight to the putter head 200. Thus, the pickaxe artifact 214 can still be rotated between the heel end 220 and toe end 222 relative to the impact face 208 via a similar engagement between the boss 256 of the puck weight 244 and a locking dimple 236 of the engagement channel 234 as is achieved between the platform 212 boss 230 and a locking dimple 236 of the engagement channel 234.

Figure 44:
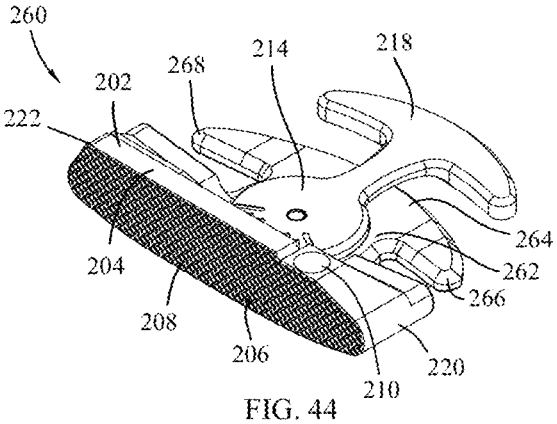
FIG. 44 is a perspective view of a further embodiment of a putter head according to the present invention.
Figure 45:
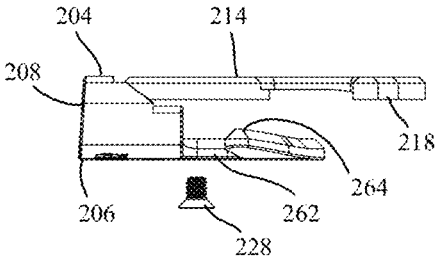
FIG. 45 is an exploded side view of the putter head shown in FIG. 44.

FIG. 44 is a perspective view of a further embodiment of a putter head according to the present invention. FIG. 45 is an exploded side view of the putter head shown in FIG. 44. Putter head 260 is substantially similar to putter head 200 described above. Like reference numbers should be understood to refer to features common among putter head 260 and putter head 200 and will not be exhaustively re-described herein. The primary difference between putter head 260 and the putter head 200 described above is that putter head 260 has winged-platform 262 extending from the body 202. Otherwise, the body 202 has a top surface 204, a bottom surface 206 and an impact face 208 formed therebetween. A putter shaft engagement means 210 is formed in the top surface 204 proximate the heel end 220. The toe end 222 is opposite the heel end 220.

The winged-platform 262 has a wing 264 integrally formed therewith opposite the impact face 208. The wing 264 arcs between the heel end 220 and the toe end 222. As shown by FIG. 45, a screw 228 is used to lock the pickaxe artifact 214 in position on the winged-platform 262 in the same manner described above. The winged-platform 262 has a central aperture 224 to receive the screw 228 in the same manner as described above. The winged-platform 262 also includes a boss 230 similarly positioned as that provided for by platform 212 to engage one of the locking dimples 236 formed by the engagement channel 234 of the pickaxe artifact 214 to facilitate the rotatability thereof.

Figure 46:
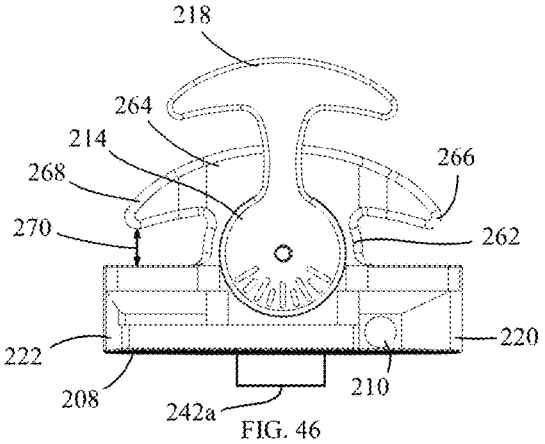
FIG. 46 is a first top view of the putter head shown in FIG. 44.
Figure 48:
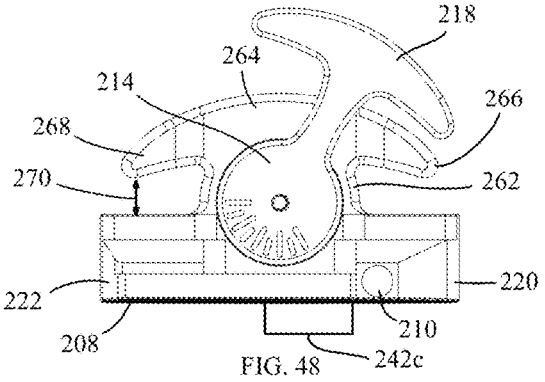
FIG. 48 is a third top view of the putter head shown in FIG. 44.
Figure 47:
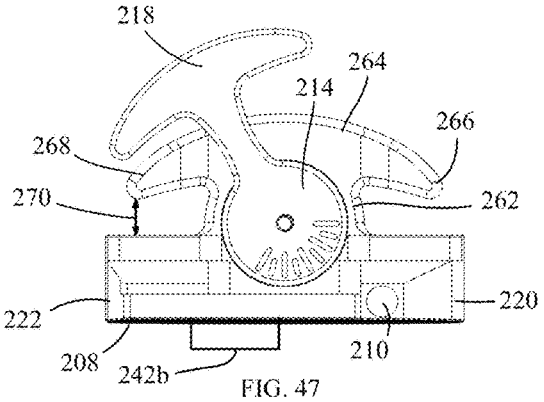
FIG. 47 is a second top view of the putter head shown in FIG. 44.

FIGS. 46 through 48 are top down views of putter head 260 demonstrating the rotatability of the pickaxe artifact 214 engagement to the winged-platform 262. As briefly mentioned above, the engagement between the pickaxe artifact 214 and the winged-platform is the same as described above with regard to platform 212 and the pickaxe artifact 214. That is, the winged-platform 262 has a boss 230 engageable to a locking dimple 236 formed within the engagement channel 234 of the pickaxe artifact 214.

The wing heel 266 and the wing toe 268 are separated from the backside of the body 202 by a gap 270. Further, as can be seen in side view of FIG. 45, the wing heel 266 and wing toe 268 angle upward at their terminal ends.

The rotatability of the pickaxe artifact 214 has a similar impact on the COG, MOI and shifting and expanding of the sweet spot 242*a-c* as discussed above and will not be again exhaustively described. It should be understood that rotation of the pickaxe artifact 214 on the winged-platform relative to the impact face 208 cause a change to the COG of the putter head 260 along two orthogonal axes that are parallel to the bottom surface of the putter head body and that are normal to the axis of rotation, one of which, e.g., the X-axis, is parallel to the impact face 208. This concept is discussed above with regard to FIG. 37 and it should be understood applies equally to the putter head 260.

The primary difference between putter head 260 now shown and putter head 200 described above is that rotation of the T-shaped extension 218 between the heel end 220 and the toe end 222 is limited by interference with winged heel 266 and the winged toe 268 of the winged-platform 262. However, even with the interference caused the winged heel 266 and winged toe 268, the pickaxe artifact 214 maintains the ability to rotate to move the T-shaped extension 218 therebetween thus causing the same change to the MOI and shifting and expansion of the sweet spot 242*a-c* discussed above.

Figure 49:
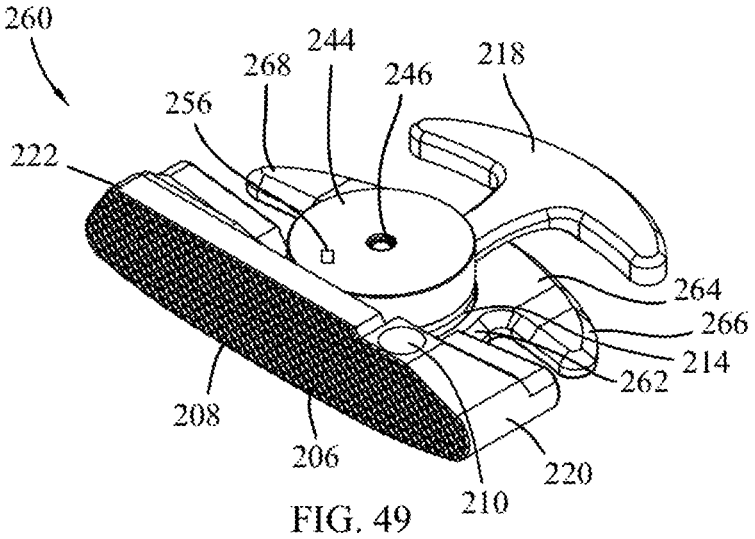
FIG. 49 is a perspective view of a further embodiment of a putter head according to the present invention.
Figure 50:
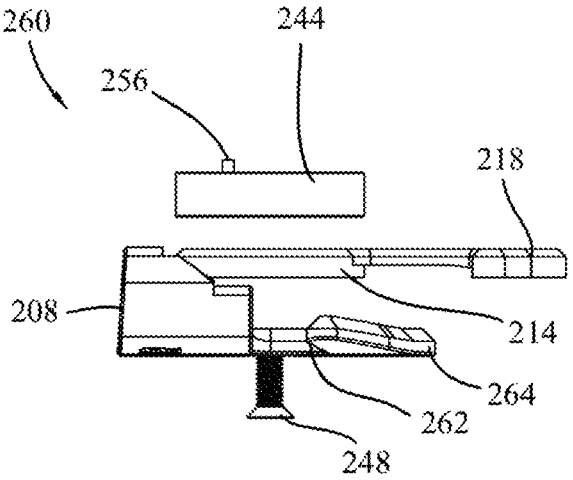
FIG. 50 is an exploded side view of the putter head shown in FIG. 49.

FIG. 49 is a perspective view of putter head 260 with a puck weight 244 attached thereto. FIG. 50 is an exploded side view of the putter head 260 shown in FIG. 49. The puck weight 244 is the same as described above and includes a central aperture 246 that aligns with the aperture 224 through the winged-platform 262 and with the threaded aperture 226 of the pickaxe artifact 214. A similar extended screw 248 may be used to lock the pickaxe artifact 214 and the puck weight 244 onto the winged-platform 262 after a player has the pickaxe artifact 214 in their desired position to maximize their putting stroke. Addition of the puck weight 244 has the same effect on the putter head 260 as describe above, namely, adding to the overall weight of the putter head 260.

Figure 51:
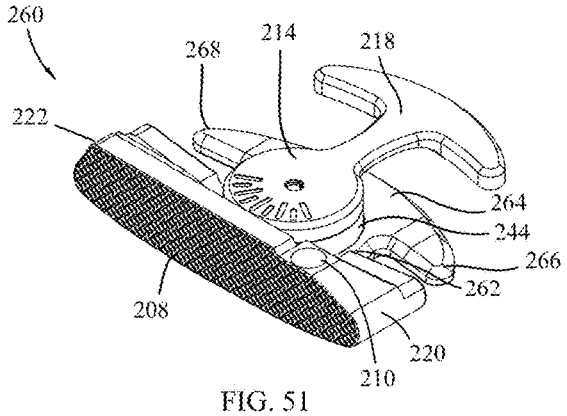
FIG. 51 is a perspective view of a further embodiment of a putter head according to the present invention.
Figure 52:
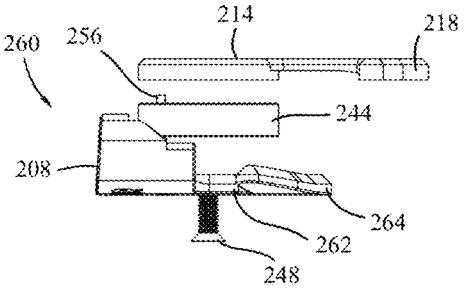
FIG. 52 is an exploded side view of the putter head shown in FIG. 51.

However, by repositioning the puck weight 244 to be attached between the pickaxe artifact 214 and the winged-platform 262, the pickaxe artifact 214 is now raised above the wing heel 266 and wing toe 268, avoiding rotational interference therewith. This is shown in the perspective view of FIG. 51 and the side view of FIG. 52. Such raising of the pickaxe artifact 214 above the wing heel 266 and wing toe 268 increases the degree with which the T-shaped extension 218 can be rotated relative to the impact face 208. Depending on the adjustment arc provided by the engagement channel 234, the T-shaped extension 218 be rotated substantially 180-degrees relative to the impact face 208, e.g., positioned completely parallel to either the heel end 220 or the toe end 222, without interference from the wing heel 266 or the wing toe 268.

Figure 53:
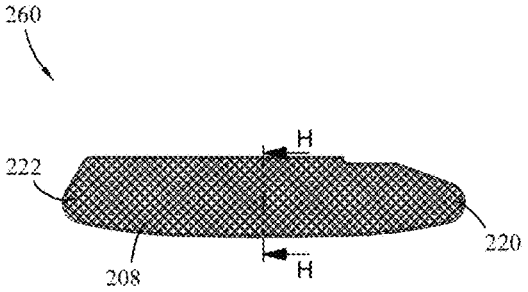
FIG. 53 is a front view of the putter head shown in FIG. 51.
Figure 54:
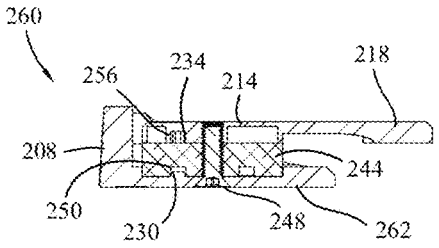
FIG. 54 is a side cross-sectional view, taken along lines H-H marked in FIG. 53, of the putter head shown in FIG. 51.

FIG. 53 is a front view of an embodiment of a putter head 260 and FIG. 54 is a cross-sectional view, taken along lines H-H marked in FIG. 53. The puck weight 244 is attached between the pickaxe artifact 214 and the winged-platform 262, raising the pickaxe artifact 214 above both heel and toe wings 266, 268 allowing for rotation of the artifact 214 along an extended arc. The puck weight 244 has a dimple 250 that engages with the boss 230 extending from the winged-platform 262, similar to that described above with regard to FIGS. 41-43. The puck weight 244 also includes a boss 256 extending from the top surface 254 thereof to engage one of the locking dimples 236 of the engagement channel 234 formed on the bottom surface 232 of the pickaxe artifact 214. The rotatability of the pickaxe artifact 214 is thereby maintained, and the heel and toe wing 266, 268 interference eliminated, by attaching the puck weight 244 between the winged-platform 262 and the pickaxe artifact 214.

In any of the aforementioned embodiments, the arm 240 of the pickaxe artifact 214 connecting the T-shaped extension to the circular body 216 may be increased or decreased, depending on the desired tunability of the putter head 200 or 260. Preferably, the putter head 200 and 260 are precisely machined using a CNC technologies. The putter head 200 and 260 may be machined from titanium, stainless steel of various grades, or aluminum depending on the desired weight of the putter head before adding an artifact thereto. Similarly, the pickaxe artifact 214 is preferably machined using CNC technologies and may be made from titanium, stainless steel of various grades, or aluminum depending on the desired weight to be added to the putter head 200 and 260.

It should be understood that while the T-shaped extension 218 is shown and described, other geometric configurations may be used to extend from the arm 240 to form artifact 214 in the above embodiments. The important feature is that the artifact extension 218 extending from the circular body 216 and attached at the end of the arm 240 has a weight greater than that of the circular body 216 so that, when rotated as described herein, the COG is shifted along the two orthogonal axes (FIG. 37) and the MOI is changed to cause a shift and expansion of the sweet spot. In some embodiments, depending on the exact weight of the artifact extension 218 at the end of the arm 240, the addition of the puck weight 244 to the circular body 216 may diminish or negate the impact the rotation of the artifact extension 218 has on the COG, MOI and sweet spot. In embodiments where the effect is negated, it may be useful for players who have further perfected there putting stroke to be a true straight-back and straight-through stroke thus not needed the finetune adjustments but yet not wishing to change putters. However, it is preferred that the weight of the artifact extension 218 be greater than the circular body 216 plus puck weight 244 to ensure the rotation thereof has the desired impact.

Further, any of the previously described ornaments may be attachable to the circular body 216, similar to the puck weight 244, to further the customization available to a player and add additional weight to the putter head 200 and 260. The puck weight 244 itself may be embodied in any of the previously described ornaments to be attached to the top surface of the circular body 216.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A putter head, comprising:

a body defining a top surface, a bottom surface, an impact face formed between the top surface and the bottom surface, and having a platform extending in a direction parallel to the bottom surface;

a means, formed in the top surface, for engaging a putter shaft;

a boss extending from the platform;

a weighted artifact attachable to the platform, the weighted artifact having top side, a bottom side and an engagement channel formed in the bottom side, the engagement channel configured to engage the boss;

a means for removably locking the weighted artifact to the platform; and a means for rotating the weighted artifact with respect to the platform to shift a center of gravity of the putter head along two orthogonal axes that are parallel to the bottom surface.

2. The putter head of claim 1, wherein the weighted artifact extends from the platform in a direction opposite the impact face and parallel to the bottom surface.

3. The putter head of claim 1, wherein the means for removably locking the weighted artifact to the platform further comprises an aperture defined through the platform.

4. The putter head of claim 3, wherein the weighted artifact further comprises a threaded aperture formed through the bottom surface and positioned to align with the aperture defined through the platform.

5. The putter head of claim 4, wherein the means for removably locking the weighted artifact to the platform further comprises a screw extending through the platform and threadably engaged with the threaded aperture.

6. The putter head of claim 1, wherein the rotation means comprises the engagement channel defining an adjustment arc that allows the weighted artifact to be rotated relative to the impact face.

7. The putter head of claim 6, wherein the adjustment arc is between a 120-degree to 180-degree arc.

8. The putter head of claim 6, wherein adjustment of the weighted artifact along the adjustment arc shifts a face balance of the putter head between a heel end of the body and a toe end of the body.

9. The putter head of claim 6, wherein adjustment of the weighted artifact along the adjustment arc is configured to change a moment of inertia of the putter head causing a shift to a sweet spot of the impact face between a heel end of the body and a toe end of the body.

10. The putter head of claim 6, wherein the adjustment arc comprises a plurality of locking dimples, each locking dimple configured to engage the boss to secure the weighted artifact at a set angle relative to the impact face.

11. The putter head of claim 10, wherein the locking dimples are equally spaced apart within the adjustment arc.

12. The putter head of claim 10, wherein each locking dimple is configured to change the set angle in equal increments.

13. The putter head of claim 1, further comprising a puck weight removably engaged to the weighted artifact.

14. The putter head of claim 1, further comprising a puck weight removably engaged between the platform and the weighted artifact.

15. The putter head of claim 1, wherein the weighted artifact comprises a T-shaped extension extending from a circular body, the circular body configured to attach to the platform.

16. The putter head of claim 15, wherein the weighted artifact is configured to rotate around the platform to cause the T-shaped extension to shift between a toe end of the body and a heel end of the body.

17. A putter head, comprising:

a body defining a top surface, a bottom surface, an impact face formed between the top surface and the bottom surface, and having a platform extending in a direction parallel to the bottom surface;

a means, formed in the top surface, for engaging a putter shaft;

a weighted artifact extending from the platform;

a means for removably attaching the weighted artifact to the platform; and a means for rotating the weighted artifact about an axis of rotation to cause a change to a center of gravity of the putter head relative to the impact face simultaneously along two orthogonal axes that are parallel to the bottom surface and that are normal to the axis of rotation.

18. The putter head of claim 17, wherein the rotation means comprises a boss extending from the platform and an engagement channel formed in a bottom surface of the weight artifact and configured to engage the boss to allow for rotation of the weighted artifact around the platform.

19. The putter head of claim 17, wherein the removable attachment means comprises an aperture defined through the platform, a threaded aperture defined in the weighted artifact and positioned be complementary to the aperture, and a screw extending through the aperture to threadably engaged the threaded aperture.

20. A putter head, comprising:

a body defining a top surface, a bottom surface, an impact face formed between the top surface and the bottom surface, and having a platform extending in a direction parallel to the bottom surface;

a means, formed in the top surface, for engaging a putter shaft;

a boss extending from the platform;

a weighted artifact attachable to the platform and extending from the platform in a direction opposite the impact face and parallel to the bottom surface, the weighted artifact having top side, a bottom side and an engagement channel formed in the bottom side, the engagement channel configured to engage the boss; and a means for removably locking the weighted artifact to the platform.

21. A putter head, comprising:

a body defining a top surface, a bottom surface, an impact face formed between the top surface and the bottom surface, and having a platform extending in a direction parallel to the bottom surface;

a means, formed in the top surface, for engaging a putter shaft;

a boss extending from the platform;

a weighted artifact attachable to the platform, the weighted artifact having top side, a bottom side and an engagement channel formed in the bottom side, the engagement channel configured to engage the boss and the engagement channel defining an adjustment arc allowing the weighted artifact to be rotated relative to the impact face; and a means for removably locking the weighted artifact to the platform.

* * * * *